US009245506B2

(12) United States Patent
Nakata

(10) Patent No.: US 9,245,506 B2
(45) Date of Patent: Jan. 26, 2016

(54) RESONANCE TONE GENERATION APPARATUS AND RESONANCE TONE GENERATION PROGRAM

(71) Applicant: Yamaha Corporation, Hamamatsu-Shi, Shizuoka-Ken (JP)

(72) Inventor: Masafumi Nakata, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/609,178

(22) Filed: Jan. 29, 2015

(65) Prior Publication Data

US 2015/0228261 A1 Aug. 13, 2015

(30) Foreign Application Priority Data

Jan. 31, 2014 (JP) ..... 2014-016940

(51) Int. Cl.
*G10H 1/06* (2006.01)
*G10H 1/00* (2006.01)
(Continued)

(52) U.S. Cl.
CPC ..... *G10H 1/06* (2013.01); *G10H 1/0091* (2013.01); *G10H 1/08* (2013.01); *G10H 1/44* (2013.01); *G10H 2210/271* (2013.01); *G10H 2210/281* (2013.01)

(58) Field of Classification Search
CPC ..... G10H 1/06
See application file for complete search history.

(56) References Cited

U.S. PATENT DOCUMENTS 3,038,363 A * 6/1962 Miessner ..... G10H 1/0535 84/363
3,470,305 A * 9/1969 Martin ..... G10C 3/06 84/363

(Continued)

FOREIGN PATENT DOCUMENTS

JP 63-267999 A 11/1988
JP 2011-028290 A 2/2011

OTHER PUBLICATIONS

Extended European Search Report dated Jun. 30, 2015, for EP Application No. 15151880.0, six pages.

*Primary Examiner* — David Warren
(74) *Attorney, Agent, or Firm* — Morrison & Foerster LLP

(57) ABSTRACT

A resonance tone generation apparatus 20 is applied to an electronic musical instrument DM having a tone generator for generating, in accordance with a tone generation instruction signal having a key number n, a musical tone signal indicative of a piano sound having a key tone pitch specified by the key number. In the resonance tone generation apparatus 20, the key numbers n are assigned. The resonance tone generation apparatus 20 has a plurality of resonance tone generation circuits $\mathbf{30}^{(n)}$ each being configured to have a plurality of resonance frequencies and each retrieving a musical tone signal indicative of a musical sound of the piano and generating a musical tone signal indicative of a resonance tone which imitates a sound of strings of the piano, the sound being resonated by the piano sound indicated by the retrieved musical tone signal. The resonance tone generation apparatus 20 also has a resonance circuit setting portion 60 which allows respective resonance frequencies of the resonance tone generation circuit $\mathbf{30}^{(n)}$ to coincide with frequencies of a fundamental tone and overtones of a musical sound $PS^{(n)}$ generated by the tone generator in accordance with tone generation instruction information including the key number n.

8 Claims, 20 Drawing Sheets

(51) Int. Cl.
*G10H 1/08* (2006.01)
*G10H 1/44* (2006.01)

(56) References Cited

U.S. PATENT DOCUMENTS 4,513,651 A * 4/1985 Deutsch ..... G10H 7/00 84/605
5,136,917 A 8/1992 Kunimoto
5,218,156 A * 6/1993 Ilzuka ..... G10H 7/06 84/624
6,180,866 B1 1/2001 Kitamura
6,725,108 B1 * 4/2004 Hall ..... G10G 7/00 381/56
8,895,831 B2 * 11/2014 Tominaga ..... G10H 5/007 84/600
2001/0027714 A1 * 10/2001 Kondo ..... G10H 1/057 84/615
2006/0048633 A1 * 3/2006 Hoguchi ..... G06Q 20/3829 84/600
2007/0107586 A1 * 5/2007 Yip ..... G10H 7/105 84/627
2007/0169612 A1 * 7/2007 Miyazawa ..... G10H 1/06 84/423 R
2007/0175318 A1 * 8/2007 Izumisawa ..... G10H 1/0091 84/626
2007/0221035 A1 * 9/2007 Muramatsu ..... G10H 1/0091 84/626
2009/0031886 A1 2/2009 Iwase
2009/0145282 A1 * 6/2009 Wang ..... G10H 3/02 84/276
2009/0241756 A1 * 10/2009 Tajima ..... G10H 1/32 84/604
2011/0064233 A1 * 3/2011 Van Buskirk ..... G10H 1/0091 381/61
2012/0174728 A1 * 7/2012 Oh ..... G10C 3/00 84/193
2012/0247306 A1 10/2012 Shimizu
2013/0061734 A1 * 3/2013 Koseki ..... G10H 1/0091 84/189
2013/0092007 A1 * 4/2013 Ohnishi ..... G10C 3/06 84/192
2015/0221296 A1 * 8/2015 Nakata ..... G10H 1/06 84/725
2015/0228261 A1 * 8/2015 Nakata ..... G10H 1/06 84/622

* cited by examiner

TBMx

| n | $G1_x^{(n)}$ | $G2_x^{(n)}$ | $DS_x^{(n)}$ |
|---|---|---|---|
| A0 | $G1_x^{(A0)}$ | $G2_x^{(A0)}$ | $DS_x^{(A0)}$ |
| A#0 | $G1_x^{(A\#0)}$ | $G2_x^{(A\#0)}$ | $DS_x^{(A\#0)}$ |
| B0 | $G1_x^{(B0)}$ | $G2_x^{(B0)}$ | $DS_x^{(B0)}$ |
| C1 | $G1_x^{(C1)}$ | $G2_x^{(C1)}$ | $DS_x^{(C1)}$ |
| ⋮ | ⋮ | ⋮ | ⋮ |
| C8 | $G1_x^{(C8)}$ | $G2_x^{(C8)}$ | $DS_x^{(C8)}$ |

TBA

| fp | $DA_{(fp)}$ |
|---|---|
| 0.0 | $DA_{(0.0)}$ |
| 0.1 | $DA_{(0.1)}$ |
| 0.2 | $DA_{(0.2)}$ |
| 0.3 | $DA_{(0.3)}$ |
| ⋮ | ⋮ |
| 0.9 | $DA_{(0.9)}$ |

TBS

| n | Wt |
|---|---|
| A0 | $wt^{(A0)}$ |
| A#0 | $wt^{(A\#0)}$ |
| B0 | $wt^{(B0)}$ |
| C1 | $wt^{(C1)}$ |
| ⋮ | ⋮ |
| C8 | $wt^{(C8)}$ |

TBTy

| pc | $Wp_y^{(pc)}$ |
|---|---|
| C | $wp_y^{(C)}$ |
| C# | $wp_y^{(C\#)}$ |
| D | $wp_y^{(D)}$ |
| D# | $wp_y^{(D\#)}$ |
| ⋮ | ⋮ |
| B | $wp_y^{(B)}$ |

RESONANCE TONE GENERATION APPARATUS AND RESONANCE TONE GENERATION PROGRAM

BACKGROUND OF THE INVENTION

1. Field of the Invention

The present invention relates to a resonance tone generation apparatus and a resonance tone generation program which are applied to an electronic musical instrument, and retrieve a musical tone signal indicative of a tone of a polyphonic musical instrument from a tone generator of the electronic musical instrument to generate a musical tone signal indicative of a resonance tone which imitates a tone of a vibrating body of the polyphonic musical instrument, the vibrating body being resonated by the retrieved musical tone signal indicative of the musical sound of the polyphonic musical instrument.

2. Description of the Related Art

Conventionally, there is a known resonance tone generation apparatus such as the one disclosed in Japanese Unexamined Patent Publication No. 63-267999. The resonance tone generation apparatus has twelve resonance tone generation circuits. Each resonance tone generation circuit is assigned one pitch name (pitch class). Each resonance tone generation circuit has a delay circuit for delaying a received musical tone signal for a period of delay time specified for the assigned pitch name, a multiplying circuit for multiplying a predetermined coefficient by the delayed musical tone signal, and an adding circuit for adding the multiplied result to a musical tone signal newly received from a tone generator and inputting the added signal to the delay circuit again. As a result, the resonance tone generation circuit has a plurality of resonance frequencies corresponding to the assigned pitch name. Among frequency components forming the tone indicated by the musical tone signal supplied to the resonance tone generation circuit, frequency components different from the resonance frequencies of the resonance tone generation circuit decay immediately, but frequency components which coincide with the resonance frequencies of the resonance tone generation circuit can remain as a resonance tone.

SUMMARY OF THE INVENTION

Among conventional electronic musical instruments, there exists an electronic musical instrument configured to retain waveform data obtained by sampling musical sounds played on various models of acoustic pianos so that a player can select a tone color (from among the various models). Frequencies of overtones of a piano sound are slightly higher than values of integral multiples of the frequency of a fundamental tone of the piano sound. The relationship in frequency between fundamental tone and overtones is referred to as inharmonicity. The inharmonicity is attributed to physical properties such as material and thickness of strings, and varies among models. However, frequencies of fundamental tone and overtones of the above-described conventional resonance tone generation circuits are fixed (unchangeable). Depending on selected tone color, therefore, there are deviations between frequencies of overtones of piano sounds supplied to the resonance tone generation circuit from the tone generator and frequencies of overtones of resonance tones generated by the resonance tone generation circuit, which causes mudded sounds.

In general, furthermore, electronic musical instruments are configured such that tuning system is selectable. In addition, it is also selectable whether to employ stretch tuning or not.

Furthermore, the frequency (master tuning) of a reference tone (A4) is programmable. In accordance with the selected tuning system, the programmed master tuning and the like, furthermore, frequencies of fundamental tones and overtones of piano sounds supplied to the resonance tone generation apparatus from the tone generator are shifted on a frequency axis as a whole for fine adjustments. However, resonance frequencies of the resonance tone generation circuits of the above-described conventional resonance tone generation apparatus are fixed (unchangeable). Furthermore, resonance frequencies of the resonance tone generation circuits are specified in accordance with equal temperament. In a case where a tuning system other than equal temperament is selected, in a case where the master tuning is changed, or the like, therefore, frequencies of fundamental tones and overtones of piano sounds supplied to the resonance tone generation circuits from the tone generator are deviated from resonance frequencies of the resonance tone generation circuits. As a result, resonance tones whose overtone frequencies are different from those of piano sounds are generated. Resultantly, sounds are mudded, or the resonance tone generation circuits are unable to resonate well, so that musical tone signals indicative of resonance tones cannot be generated that much by the resonance tone generation circuits. Therefore, the conventional electronic musical instruments cannot faithfully imitate resonance tones of different models of acoustic pianos and acoustic pianos each having different settings on tuning.

The present invention was accomplished to solve the above-described problem, and an object thereof is to provide a resonance tone generation apparatus which can more faithfully imitate resonance tones of different models of polyphonic musical instruments and resonance tones of polyphonic musical instruments each having different settings on tuning. In descriptions of constituent features of the present invention which will be described below, numerical references of corresponding components of an embodiment which will be described later are given in parentheses in order to facilitate the understanding of the invention. However, it should not be understood that the constituent features of the invention are limited to the corresponding components of the embodiment indicated by the numerical references.

In order to achieve the above-described object, it is a feature of the present invention to provide a resonance tone generation apparatus (20) applied to an electronic musical instrument (DM) having a tone generator (16) which generates a musical tone signal indicative of a musical sound ($PS^{(n)}$) which has a tone pitch specified by a tone pitch number (n) and is generated by a polyphonic musical instrument by vibrating a vibrating body corresponding to the tone pitch number, in accordance with a tone generation instruction signal including the tone pitch number, the resonance tone generation apparatus including a plurality of resonance tone generation portions ($\mathbf{30}^{(n)}$) each of which is assigned a different tone pitch number and is configured to have a plurality of resonance frequencies, each of the plurality of resonance tone generation portions retrieving a musical tone signal indicative of a musical sound of the polyphonic musical instrument and generating a musical tone signal indicative of a resonance tone imitating a tone of a vibrating body of the polyphonic musical instrument resonated by the musical sound of the polyphonic musical instrument indicated by the retrieved musical tone signal; and a resonance frequency setting portion (60) for allowing respective resonance frequencies of the each resonance tone generation portion to coincide with frequencies of a fundamental tone and overtones of the musical sound generated by the tone generator in accordance with tone generation instruction information including the tone pitch number assigned to the each resonance tone generation portion. In a case where a difference between the resonance frequencies of the resonance tone generation portion and frequencies of a fundamental tone and overtones of the musical sound generated by the tone generator in accordance with tone generation instruction information having the tone pitch number assigned to the resonance tone generation portion is equal to or lower than a certain threshold value, it can be considered that the resonance frequencies of the resonance tone generation portion coincide with the frequencies of the fundamental tone and overtones of the musical sound generated by the tone generator in accordance with the tone generation instruction information having the tone pitch number assigned to the resonance tone generation portion.

In this case, each of the plurality of resonance tone generation portions may have a delay portion (43$^{(n)}$) for retaining the retrieved musical tone signal and delaying the retained musical tone signal; a delay length adjustment portion (44$^{(n)}$) for uniformly delaying phase of an entire frequency band of the musical tone signal delayed by the delay portion to adjust a period of delay time delayed by the delay portion; one or more phase shift portion (45$^{(n)}$, 46$^{(n)}$) having phase characteristic which delays a low frequency component of the musical tone signal delayed by the delay portion and the delay length adjustment portion longer than a high frequency component; and an adding portion (42$^{(n)}$) for adding the musical tone signal in which respective phases of the frequency components were shifted by the one or more phase shift portion to a musical tone signal newly retrieved from the tone generator, and then supplying the added musical tone signal to the delay portion; and the resonance frequency setting portion may specify a period of time for which the musical tone signal is to be retained by the delay portion, phase characteristic of the delay length adjustment portion, and the phase characteristic of the one or more phase shift portion such that the respective resonance frequencies of the resonance tone generation portion coincide with the frequencies of the fundamental tone and overtones of the musical sound generated by the tone generator in accordance with the tone generation instruction information including the tone pitch number assigned to the resonance tone generation portion.

In this case, furthermore, a total period of time (DS$^{(n)}$) during which the musical tone signal is to be delayed by the delay portion and the delay length adjustment portion may have an integer portion and a decimal portion; and the resonance frequency setting portion may determine a period of time (DL$^{(n)}$) for which the musical tone signal is to be retained by the delay portion in accordance with a value of the integer portion, and may specify the phase characteristic (DA$^{(n)}$) of the delay length adjustment portion in accordance with a value of the decimal portion.

The polyphonic musical instrument may be a piano; and the vibrating body may be a string of the piano.

Each resonance tone generation portion of the resonance tone generation apparatus configured as above has a plurality of resonance frequencies defined on the basis of the period of time for which a musical tone signal is to be retained by the delay portion, the phase characteristic of the delay length adjustment portion, and the phase characteristic of the one or more phase shift portion. According to the resonance tone generation apparatus of the invention, resonance frequencies of the resonance tone generation portion are determined in accordance with the selected tone color (model), temperament, master tuning and the like. More specifically, the resonance frequency setting portion allows the resonance frequencies of the resonance tone generation portion coincide with the frequencies of the fundamental tone and overtones of the musical sound supplied from the tone generator. Therefore, the resonance tone generation apparatus prevents occasions where sounds are mudded, or the resonance tone generation portion is unable to resonate well due to deviation between the frequencies of the fundamental tone and overtones of the musical sound supplied from the tone generator, and the resonance frequencies of the resonance tone generation portion. Therefore, the electronic musical instrument to which the resonance tone generation apparatus according to the present invention is applied can more faithfully imitate different models of polyphonic musical instruments and polyphonic musical instruments each having different settings on tuning.

It is another feature of the present invention that the resonance tone generation apparatus is applied to an electronic musical instrument on which tone pitches and a tone color of musical sounds of the polyphonic musical instrument can be specified in accordance with musical sound setting information including model information indicative of a model of polyphonic musical instrument imitated by the electronic musical instrument, and tuning system information indicative of setting on tuning, the electronic musical instrument being capable of externally outputting the musical sound setting information; the resonance frequency setting portion has a musical sound setting information retrieving portion for retrieving the musical sound setting information; a basic table (TBM1, TBM2, . . . ) which specifies a parameter specifying a total period of time during which a musical tone signal is to be delayed by the delay portion and the delay length adjustment portion, and a parameter specifying phase characteristic of the one or more phase shift portion in a case where a reference tone has a certain tone pitch, while the electronic musical instrument is to imitate a certain model of polyphonic musical instrument tuned by a certain tuning system, for each of the plurality of resonance tone generation portions; and a plurality of correction tables (TBT1, TBT2, . . . , TBS) which specify a coefficient which is to be multiplied by the parameters of the basic table in a case where the electronic musical instrument is to imitate the certain model (M1, M2, . . . ) of polyphonic musical instrument tuned by a tuning system different from the certain tuning system, the coefficient being provided for each of tuning systems which are different from the certain tuning system; and in accordance with the retrieved musical sound setting information, by use of the basic table and one or more of the correction tables, the period of time for which the musical tone signal is to be retained by the delay portion, the phase characteristic of the delay length adjustment portion, and the phase characteristic of the one or more phase shift portions are specified for each of the plurality of resonance tone generation portions.

In this case, at least one of the correction tables (TBT1, TBT2, . . . ) may be formed of twelve coefficients each corresponding to a different pitch name.

In a case where the setting on tuning of the electronic musical instrument is set to a certain setting, the respective resonance frequencies of the resonance tone generation portion are specified by use of the basic table. In a case where the setting on tuning is set to a setting which is different from the certain setting, the parameters of the basic table are corrected by use of the correction tables. As a result, respective configurations of the tables can be simplified, compared with a case where parameters which are to be supplied to the resonance tone generation portion are stored for each setting on tuning of the electronic musical instrument.

It is a further feature of the present invention that the resonance frequency setting portion has a frequency response detecting portion (S24*c*) for sequentially retrieving musical sounds each having a different tone pitch of the polyphonic musical instrument from the tone generator, and detecting respective frequencies of fundamental tones and overtones of the musical sounds each having a different tone pitch of the polyphonic musical instrument; an initializing portion (S24*d*) for initializing the period of time for which the musical tone signal is to be retained by the delay portion, the phase characteristic of the delay length adjustment portion, and the phase characteristic of the one or more phase shift portion to certain initial values for each of the plurality of resonance tone generation portion; a resonance frequency detecting portion (S24*e*) for detecting resonance frequencies of each of the plurality of resonance tone generation portion; and an optimizing portion (S24*g*, S24*h*) for optimizing resonance frequencies of each of the plurality of resonance tone generation portion by repeatedly updating the period of time for which the musical tone signal is to be retained by the delay portion, the phase characteristic of the delay length adjustment portion, and the phase characteristic of the one or more phase shift portion for each of the plurality of resonance tone generation portion until a difference (SS) between the resonance frequencies of the each resonance tone generation portion and the frequencies of the fundamental tone and overtones of the polyphonic musical instrument's musical sound having a corresponding tone pitch generated by the tone generator in accordance with the tone generation instruction information including the tone pitch number assigned to the each resonance tone generation portion becomes smaller than a certain threshold value.

The above-described feature can omit the basic table and the correction tables, simplifying the configuration of the resonance tone generation apparatus.

Furthermore, the present invention is not limited to the invention of the resonance tone generation apparatus, but can be embodied as a computer program applied to a computer incorporated in a resonance tone generation apparatus.

DESCRIPTION OF THE PREFERRED EMBODIMENT

A resonance tone generation apparatus 20 according to an embodiment of the present invention will now be described. First, an electronic musical instrument DM to which the resonance tone generation apparatus 20 is applied will be schematically explained. The electronic musical instrument DM is capable of generating musical sounds imitating musical sounds played on acoustic pianos of various models M1, M2, . . . . On the electronic musical instrument DM, furthermore, temperament is selectable. In addition, a master tuning (tone pitch of a reference tone (A4)) can be specified on the electronic musical instrument DM. Furthermore, whether to employ stretch tuning or not is selectable.

Figure 1:
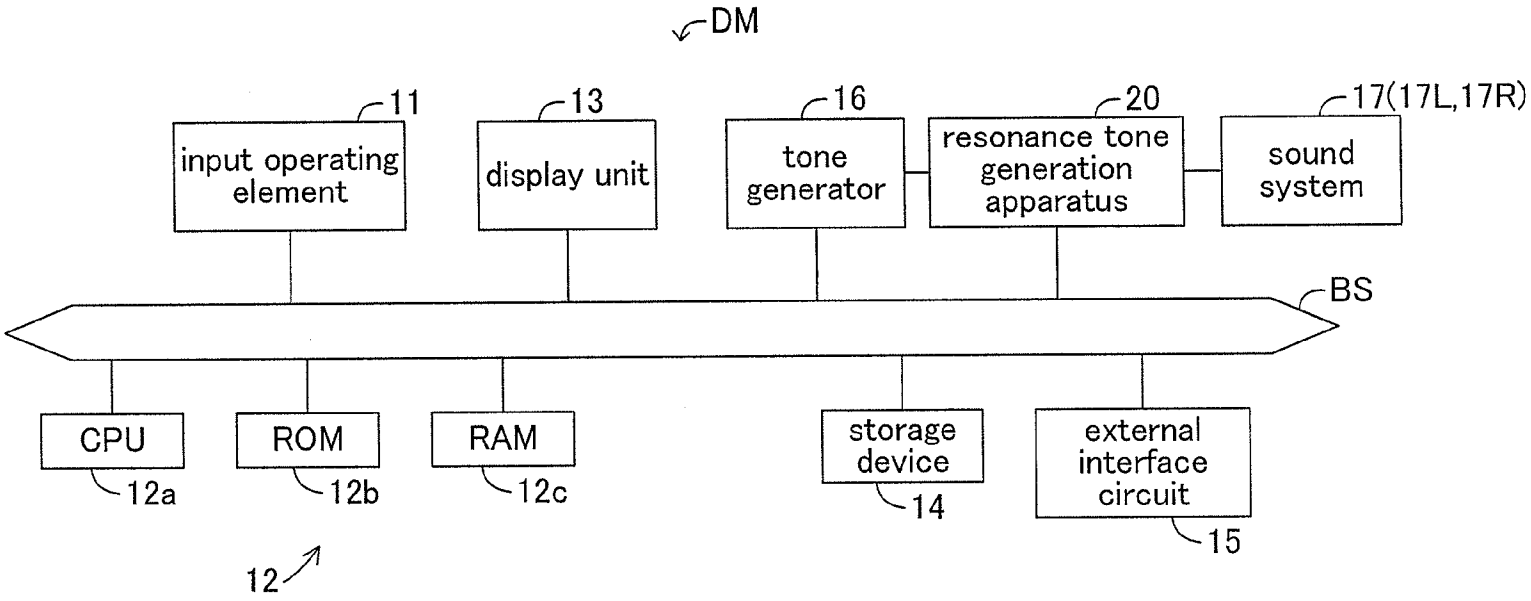
FIG. 1 is a block diagram showing a configuration of an electronic musical instrument to which a resonance tone generation apparatus according to an embodiment of the present invention is applied.

As indicated in FIG. 1, the electronic musical instrument DM has not only the resonance tone generation apparatus 20 but also an input operating element 11, a computer portion 12, a display unit 13, a storage device 14, an external interface circuit 15, a tone generator 16, and a sound system 17, with these components except the sound system 17 being connected with each other via a bus BS.

The input operating element 11 includes a musical performance operating element and a setting operating element. The musical performance operating element is composed of a keyboard apparatus, a pedal apparatus and the like. The keyboard apparatus has a plurality of keys. The pedal apparatus has a damper pedal. The setting operating element is composed of switches which are to be turned on/off (such as a numeric keypad for inputting numeric values), volumes or rotary encoders which are to be rotated, volumes or linear encoders which are to be slid, a mouse, a touch panel and the like. The musical performance operating element and the setting operating element are used in order to start and stop generation of musical tones, to select a tone color (any one of the models M1, M2, . . . ), to select a temperament, and to set a master tuning. By the manipulation of the input operating element 11, operational information indicative of the content of the manipulation is supplied to the computer portion 12 which will be explained later via the bus BS.

The computer portion 12 is composed of a CPU 12*a*, a ROM 12*b* and a RAM 12*c* which are connected to the bus BS. The CPU 12*a* reads out a main program which will be described later from the ROM 12*b*, and executes the main program. For instance, the CPU 12*a* supplies musical performance operational information relating to manipulation of the key and the manipulation of the pedal apparatus to the tone generator 16 and the resonance tone generation apparatus 20. For instance, furthermore, the CPU 12*a* supplies musical sound setting information relating to the setting on musical sounds which are to be output from the tone generator 16 to the tone generator 16 and the resonance tone generation apparatus 20. The musical sound setting information includes model information which specifies a model selected from among the models M1, M2, . . . , and tuning system information which specifies tuning system. The tuning system information includes temperament information such as equal temperament and Werckmeister, stretch tuning information indicative of whether stretch tuning is to be employed or not, and master tuning information indicative of master tuning.

In the ROM 12*b*, not only the main program but also initial setting parameters and various kinds of data such as graphic data and character data for generating display data indicative of images which are to be displayed on the display unit 13 are stored. In the RAM 12*c*, data necessary for executing various kinds of programs is temporarily stored.

The display unit 13 is composed of a liquid crystal display (LCD). The computer portion 12 generates display data indicative of content to be displayed, using graphic data, character data and the like. The computer portion 12 then supplies the generated display data to the display unit 13. The display unit 13 displays images on the basis of display data supplied from the computer portion 12.

The storage device 14 is composed of high-capacity non-volatile storage media such as HDD, FDD, CD and DVD, and drive units for the respective storage media. The external interface circuit 15 has a connecting terminal which allows the electronic musical instrument DM to connect with an external apparatus such as a different electronic musical apparatus or a personal computer. Via the external interface circuit 15, the electronic musical instrument DM can be also connected with a communications network such as LAN (Local Area Network) or Internet.

The tone generator 16 has a waveform memory in which a plurality of waveform data sets are stored. In this embodiment, sample values obtained by stereo-sampling musical sounds (single tones) generated by depressions of keys on the acoustic piano models M1, M2, . . . at a predetermined sampling period (every $1/44100$th of a second) are stored in the waveform memory as waveform data. For the sampling, the pianos of the models M1, M2, . . . are tuned in equal temperament. Furthermore, the master tuning is set to "440 Hz", while the stretch tuning is not employed. In accordance with the musical performance operational information and the musical sound setting information supplied from the CPU 12*a*, the tone generator 16 reads out waveform data from the waveform memory, generates digital musical tone signals, and supplies the generated digital musical tone signals to the resonance tone generation apparatus 20. As described above, since musical sounds played on the acoustic pianos have been stereo-sampled, the digital musical tone signals are composed of left channel signals representative of musical sounds which are to be output from a left speaker, and right channel signals representative of musical sounds which are to be output from a right speaker. At each sampling period, more specifically, one sample value making up a left channel signal and one sample value making up a right channel signal are supplied to the resonance tone generation apparatus 20.

The resonance tone generation apparatus 20 generates digital musical tone signals representative of resonance tones by use of the digital musical tone signals supplied from the tone generator 16, and supplies the generated digital musical tone signals to the sound system 17.

The sound system 17 has a D/A converter for converting the digital tone signals supplied from the resonance tone generation apparatus 20 to analog tone signals, an amplifier for amplifying the converted analog tone signals, and a pair of right and left speakers (outputting portion) for converting the amplified analog tone signals to sound signals and outputting the sound signals.

Figure 2:
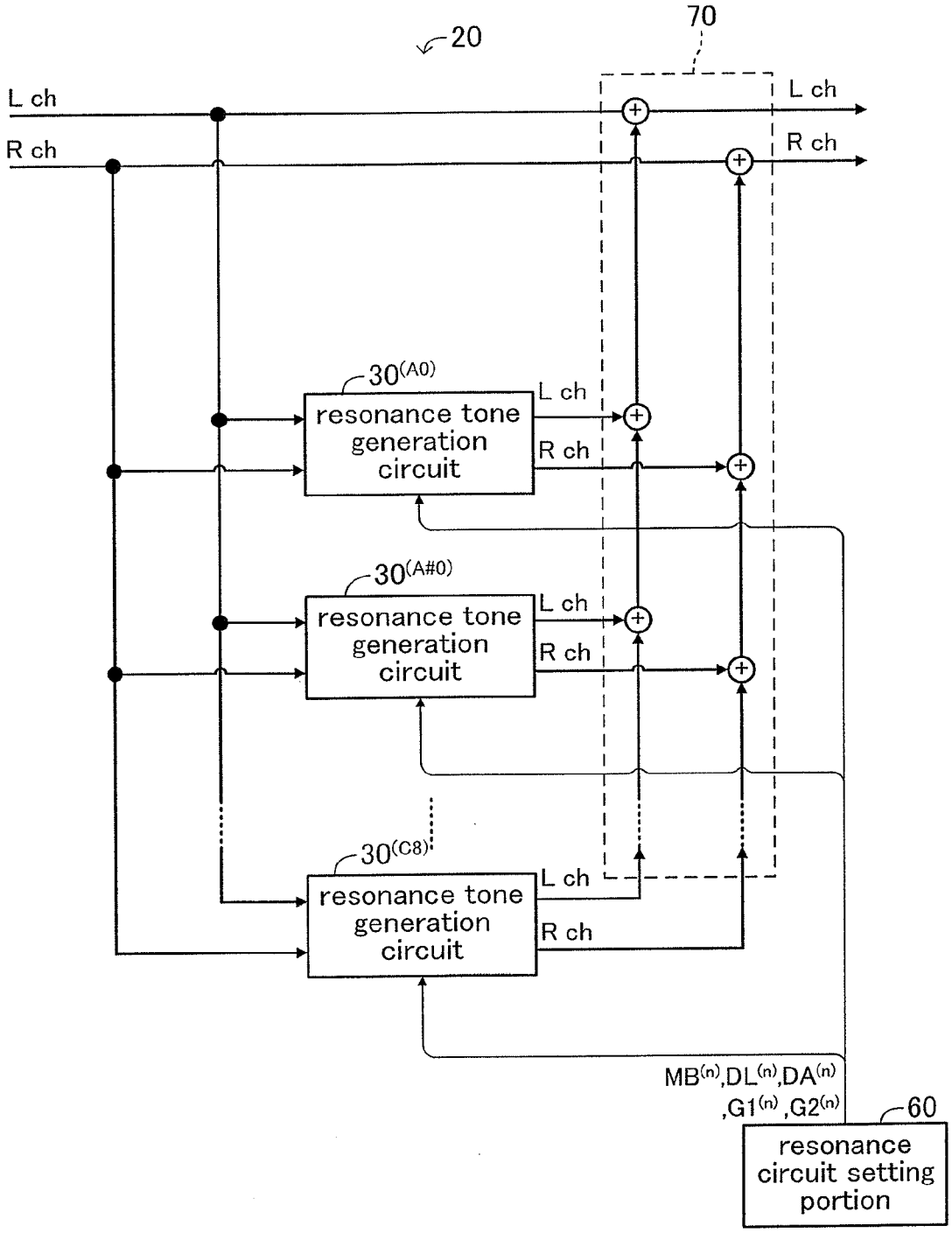
FIG. 2 is a block diagram showing a configuration of the resonance tone generation apparatus shown in FIG. 1.
Figure 3:
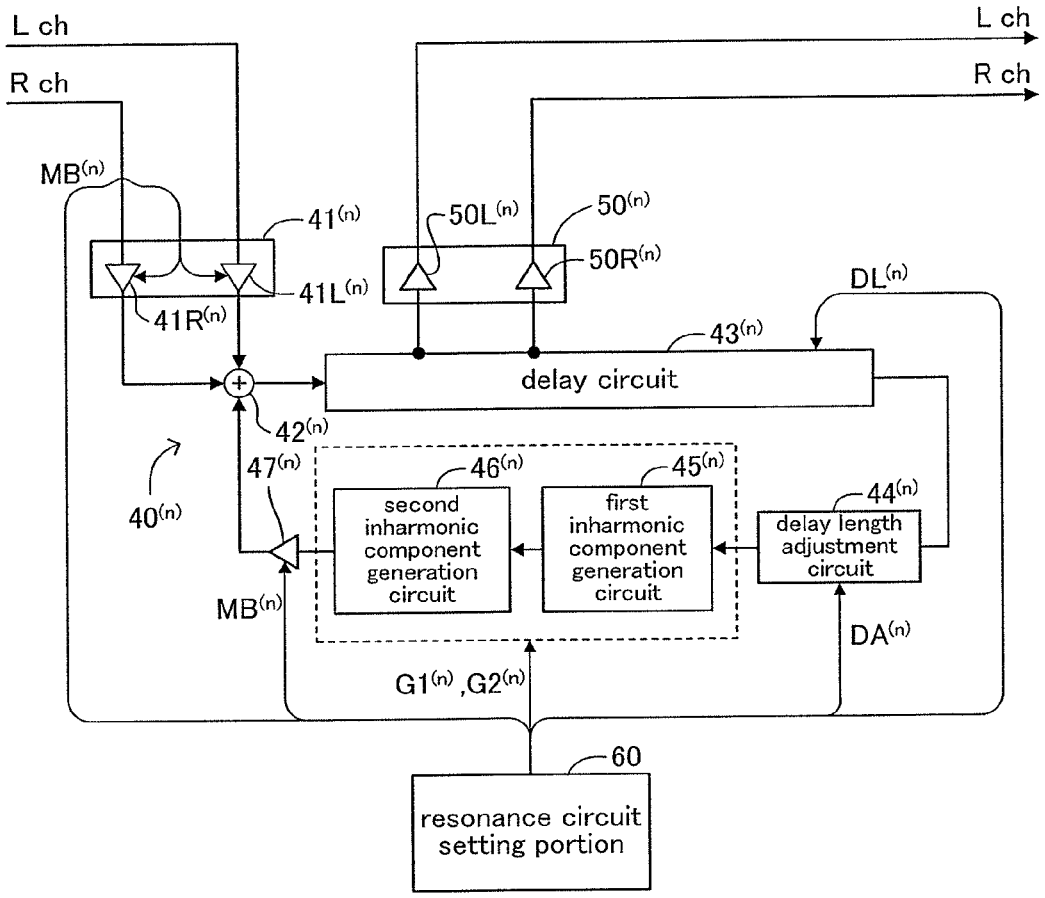
FIG. 3 is a block diagram showing a configuration of a resonance tone generation circuit shown in FIG. 2.

Next, a schematic configuration of the resonance tone generation apparatus 20 will be explained. As indicated in FIG. 2, the resonance tone generation apparatus 20 has a plurality of resonance tone generation circuits $\mathbf{30}^{(n=A0\ to\ C8)}$. As indicated in FIG. 3, the resonance tone generation circuit $\mathbf{30}^{(n)}$ has a resonance circuit $\mathbf{40}^{(n)}$ for generating digital musical tone signals representative of resonance tones, and a panning setting circuit $\mathbf{50}^{(n)}$ for setting panning of the resonance tones. Furthermore, the resonance tone generation apparatus 20 also has a resonance circuit setting portion 60 which generates resonance circuit setting information indicative of respective settings of the resonance circuits $\mathbf{40}^{(n)}$ and supplies the generated information to the resonance tone generation circuits $\mathbf{30}^{(n)}$, and an adding portion 70 which adds digital musical tone signals representative of resonance tone to digital musical tone signals representative of musical sound supplied from the tone generator 16, and supplies the added signals to the sound system 17. The resonance circuit setting information includes open close data $MB^{(n)}$, delay length data $DL^{(n)}$), delay length adjustment data $DA^{(n)}$, first inharmonic component setting data $G1^{(n)}$, and second inharmonic component setting data $G2^{(n)}$. The open close data $MB^{(n)}$ is the data for selecting a string (key number n) whose resonance tone is to be imitated. The delay length data $DL^{(n)}$, delay length adjustment data $DA^{(n)}$, first inharmonic component setting data $G1^{(n)}$, and second inharmonic component setting data $G2^{(n)}$ are data which determines resonance frequency of the resonance tone generation circuit $\mathbf{30}^{(n)}$. In other words, the delay length data $DL^{(n)}$ and the delay length adjustment data $DA^{(n)}$ are data which determines frequency of a fundamental tone of a resonance tone. The first inharmonic component setting data $G1^{(n)}$ and the second inharmonic component setting data $G2^{(n)}$ are data which determines frequencies of overtones of the resonance tone.

Next, a configuration of the resonance tone generation circuit $\mathbf{30}^{(n)}$ will be explained. Each of the resonance tone generation circuits $\mathbf{30}^{(n)}$ is assigned a corresponding key number n. A key number n is a number which uniquely identifies a tone pitch of a key, and is uniquely associated with a combination of a pitch class and an octave number. More specifically, a key number n can be represented as "A0", "A#0", . . . , or "C8". The resonance tone generation circuits $\mathbf{30}^{(A0)}$ to $\mathbf{30}^{(C8)}$ are configured the same. A digital musical tone signal output from the tone generator 16 is supplied to each resonance tone generation circuit $\mathbf{30}^{(n)}$. Lines for supplying digital musical tone signals are provided for the respective resonance tone generation circuits $\mathbf{30}^{(n)}$ in parallel. Therefore, a digital musical tone signal output from the tone generator 16 is supplied concurrently to all the resonance tone generation circuits $\mathbf{30}^{(n)}$. At each sampling period (that is, every $1/44100$th of a second in this embodiment), more specifically, one sample value making up a left channel signal and one sample value making up a right channel signal are concurrently supplied to all the resonance tone generation circuits $30^{(n)}$.

As indicated in FIG. 3, each resonance circuit $40^{(n)}$ has a reception circuit $41^{(n)}$, an adding circuit $42^{(n)}$, a delay circuit $43^{(n)}$, a delay length adjustment circuit $44^{(n)}$, a first inharmonic component generation circuit $45^{(n)}$, a second inharmonic component generation circuit $46^{(n)}$, and a multiplying circuit $47^{(n)}$.

A digital musical tone signal representative of a piano musical sound is supplied to the reception circuit $41^{(n)}$. The reception circuit $41^{(n)}$ has a multiplying circuits $41L^{(n)}$ and $41R^{(n)}$. The multiplying circuits $41L^{(n)}$ and $41R^{(n)}$ multiply a sample value of a left channel signal and a sample value of a right channel signal supplied from the tone generator 16, respectively, by the open close data $MB^{(n)}$ supplied from the resonance circuit setting portion 60, and supply the multiplied results to the adding circuit $42^{(n)}$.

The adding circuit $42^{(n)}$ adds the sample value of the left channel signal and the sample value of the right channel signal supplied from the reception circuit $41^{(n)}$, and further adds the added result and a sample value supplied from the multiplying circuit $47^{(n)}$ which will be described later. The adding circuit $42^{(n)}$ then supplies the added result to the delay circuit $43^{(n)}$.

Figure 4:
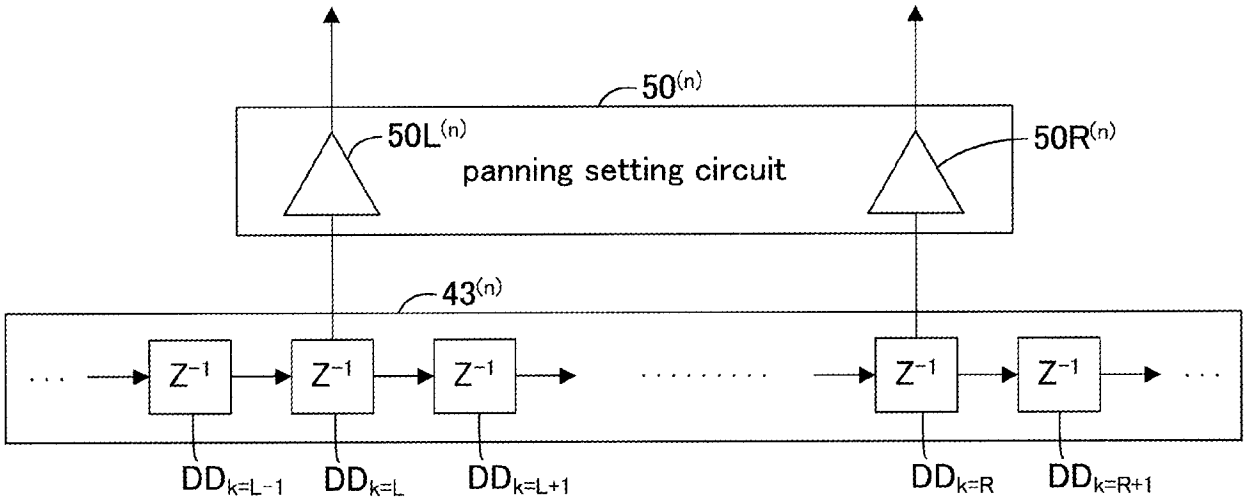
FIG. 4 is a block diagram showing a configuration of a delay circuit shown in FIG. 3.

After retaining the sample value supplied from the adding circuit $42^{(n)}$ for a time period corresponding to the delay length data $DL^{(n)}$ supplied from the resonance circuit setting portion 60, the delay circuit $43^{(n)}$ supplies the sample value to the delay length adjustment circuit $44^{(n)}$. As indicated in FIG. 4, more specifically, the delay circuit $43^{(n)}$ is formed of a plurality of delay elements $DD_{k(=1, 2, \ldots, K)}$ connected in series. The letter "k" is an index for identifying a corresponding delay element. The delay element $DD_1$ is connected to the adding circuit $42^{(n)}$, with the delay elements $DD_2, DD_3, \ldots, DD_K$ being connected sequentially toward the delay length adjustment circuit $44^{(n)}$. The delay element $DD_k$ is capable of retaining one supplied sample value. When a new sample value is supplied to the delay element $DD_k$, the delay element $DD_k$ supplies a sample value which the delay element $DD_k$ has retained to the delay element $DD_{k+1}$, and retains the newly supplied sample value. When the new sample value is supplied to the delay element $DD_K$, the delay element $DD_K$ supplies a sample value which the delay element $DD_k$ has retained to the delay length adjustment circuit $44^{(n)}$. The total number (that is, the value "K") of delay elements which make up the delay circuit $43^{(n)}$ varies with the delay length data $DL^{(n)}$.

Figure 5:
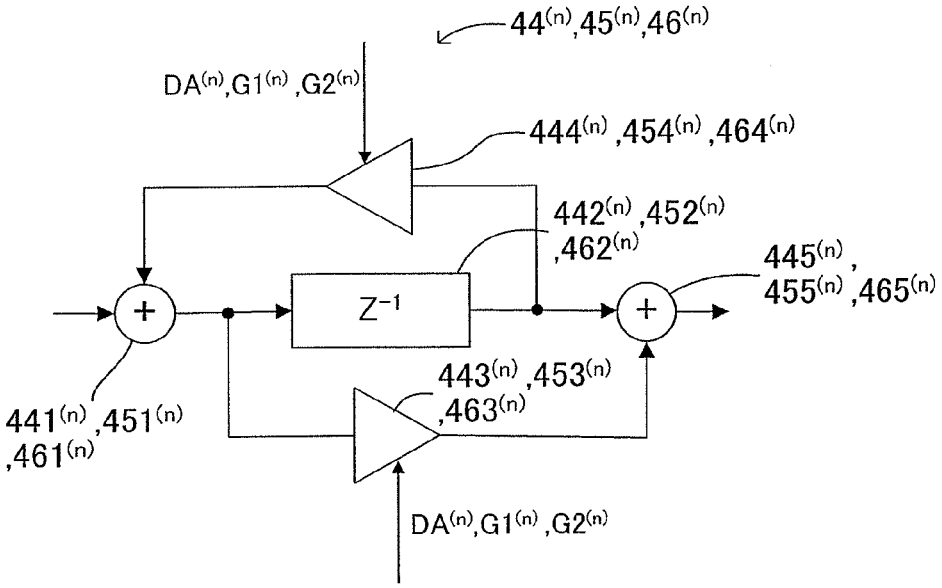
FIG. 5 is a block diagram showing a configuration of a delay length adjustment circuit, a first inharmonic component generation circuit and a second inharmonic component generation circuit shown in FIG. 3.

Although the above-described delay circuit $43^{(n)}$ allows specification of the delay length on a sample basis, the delay length adjustment circuit $44^{(n)}$ is provided in order to allow further elaborate specification of delay length. As indicated in FIG. 5, the delay length adjustment circuit $44^{(n)}$ is a primary all-pass filter. More specifically, the delay length adjustment circuit $44^{(n)}$ has an adding circuit $441^{(n)}$, a delay element $442^{(n)}$, a multiplying circuit $443^{(n)}$, a multiplying circuit $444^{(n)}$, and an adding circuit $445^{(n)}$. The adding circuit $441^{(n)}$ adds a sample value supplied from the delay circuit $43^{(n)}$ to a sample value supplied from the multiplying circuit $444^{(n)}$ which will be described later, and then supplies the added sample value to the delay element $442^{(n)}$ and the multiplying circuit $443^{(n)}$. The delay element $442^{(n)}$ is configured similarly to the delay elements of the delay circuit $43^{(n)}$. The delay element $442^{(n)}$ supplies the delayed sample value to the multiplying circuit $444^{(n)}$ and the adding circuit $445^{(n)}$. The multiplying circuit $443^{(n)}$ multiplies the delay length adjustment data $DA^{(n)}$ supplied from the resonance circuit setting portion 60 by "−1", multiplies the multiplied result by the sample value supplied from the adding circuit $441^{(n)}$, and supplies the multiplied result to the adding circuit $445^{(n)}$. The multiplying circuit $444^{(n)}$ multiplies the sample value supplied from the delay element $442^{(n)}$ by the delay length adjustment data $DA^{(n)}$ supplied from the resonance circuit setting portion 60, and supplies the multiplied result to the adding circuit $441^{(n)}$. The adding circuit $445^{(n)}$ adds respective sample values supplied from the delay element $442^{(n)}$ and the multiplying circuit $443^{(n)}$, and supplies the added result to the first inharmonic component generation circuit $45^{(n)}$.

Figure 6:
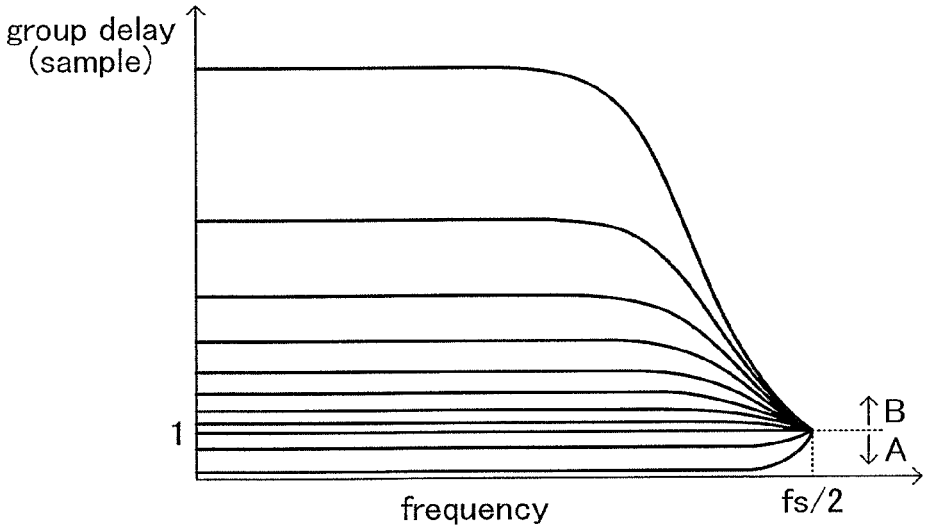
FIG. 6 is a graph showing group delay characteristics of an all-pass filter.

Generally, the primary all-pass filter has group delay characteristics such as shown in FIG. 6. More specifically, in accordance with a gain value of the multiplying circuit $443^{(n)}$ and the multiplying circuit $444^{(n)}$, the number of delay samples in an area of frequencies lower than the Nyquist frequency (fs/2) varies. By specifying the gain (delay length adjustment data $DA^{(n)}$) of the multiplying circuit $443^{(n)}$ and the multiplying circuit $444^{(n)}$ so that the group delay characteristics of the delay length adjustment circuit $44^{(n)}$ are included in an area "A" shown in the figure, a delay length smaller than 1 sample can be specified.

The circuit configuration of the first inharmonic component generation circuit $45^{(n)}$ and the second inharmonic component generation circuit $46^{(n)}$ is similar to that of the delay length adjustment circuit $44^{(n)}$. More specifically, the first inharmonic component generation circuit $45^{(n)}$ has an adding circuit $451^{(n)}$, a delay element $452^{(n)}$, a multiplying circuit $453^{(n)}$, a multiplying circuit $454^{(n)}$, and an adding circuit $455^{(n)}$ The adding circuit $451^{(n)}$ adds a sample value supplied from the delay length adjustment circuit $44^{(n)}$ to a sample value supplied from the multiplying circuit $454^{(n)}$ which will be described later, and then supplies the added sample value to the delay element $452^{(n)}$ and the multiplying circuit $453^{(n)}$. The delay element $452^{(n)}$ is configured similarly to the delay element of the delay circuit $43^{(n)}$. The delay element $452^{(n)}$ supplies the delayed sample value to the multiplying circuit $454^{(n)}$ and the adding circuit $455^{(n)}$. The multiplying circuit $453^{(n)}$ multiplies the first inharmonic component setting data $G1^{(n)}$ supplied from the resonance circuit setting portion 60 by "−1", multiplies the multiplied result by the sample value supplied from the adding circuit $451^{(n)}$, and supplies the multiplied result to the adding circuit $455^{(n)}$. The multiplying circuit $454^{(n)}$ multiplies the sample value supplied from the delay element $452^{(n)}$ by the first inharmonic component setting data $G1^{(n)}$ supplied from the resonance circuit setting portion 60, and supplies the multiplied result to the adding circuit $451^{(n)}$. The adding circuit $455^{(n)}$ adds sample values supplied from the delay element $452^{(n)}$ and the multiplying circuit $453^{(n)}$, and supplies the added result to the second inharmonic component generation circuit $46^{(n)}$.

The second inharmonic component generation circuit $46^{(n)}$ has an adding circuit $461^{(n)}$, a delay element $462^{(n)}$, a multiplying circuit $463^{(n)}$, a multiplying circuit $464^{(n)}$, and an adding circuit $465^{(n)}$. The adding circuit $461^{(n)}$ adds a sample value supplied from the first inharmonic component generation circuit $45^{(n)}$ to a sample value supplied from the multiplying circuit $464^{(n)}$ which will be described later, and then supplies the added sample value to the delay element $462^{(n)}$ and the multiplying circuit $463^{(n)}$. The delay element $462^{(n)}$ is configured similarly to the delay element of the delay circuit $43^{(n)}$. The delay element $462^{(n)}$ supplies the delayed sample value to the multiplying circuit $464^{(n)}$ and the adding circuit $465^{(n)}$. The multiplying circuit $463^{(n)}$ multiplies the second inharmonic component setting data $G2^{(n)}$ supplied from the resonance circuit setting portion 60 by "−1", multiplies the multiplied result by the sample value supplied from the adding circuit 461$^{(n)}$, and supplies the multiplied result to the adding circuit 465$^{(n)}$. The multiplying circuit 464$^{(n)}$ multiplies the sample value supplied from the delay element 462$^{(n)}$ by the second inharmonic component setting data G2$^{(n)}$ supplied from the resonance circuit setting portion 60, and supplies the multiplied result to the adding circuit 461$^{(n)}$. The adding circuit 465$^{(n)}$ adds sample values supplied from the delay element 462$^{(n)}$ and the multiplying circuit 463$^{(n)}$, and supplies the added result to the multiplying circuit 47$^{(n)}$.

The multiplying circuit 47$^{(n)}$ multiplies the open close data MB$^{(n)}$ supplied from the resonance circuit setting portion 60 by the sample value supplied from the second inharmonic component generation circuit 46$^{(n)}$, multiplies the multiplied result by a predetermined decay coefficient ("0.8", for example), and supplies the multiplied result to the adding circuit 42$^{(n)}$.

Figure 7:
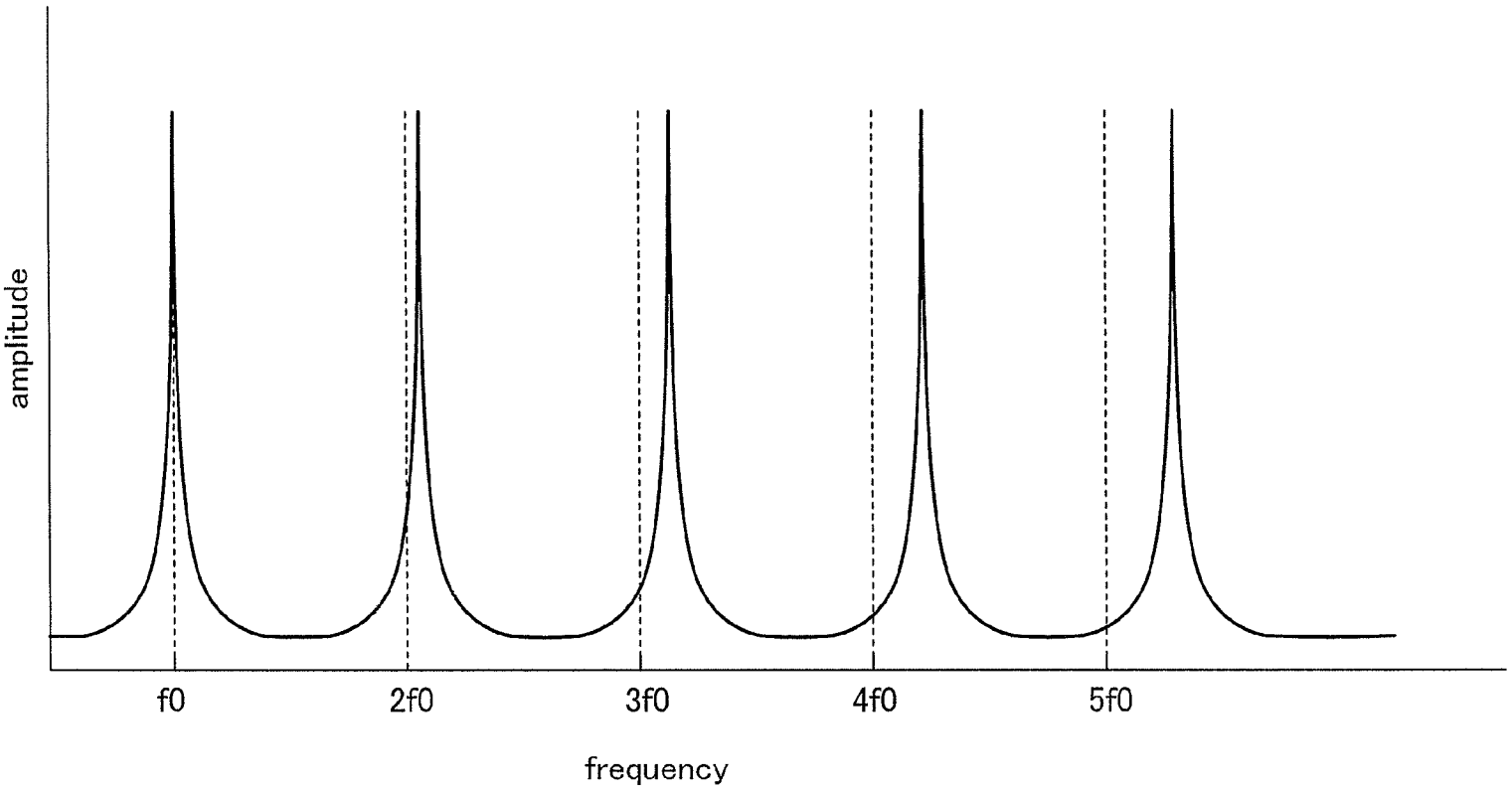
FIG. 7 is a graph schematically showing amplitude characteristics of a piano sound.

If the resonance tone generation apparatus 20 is configured such that the output of the delay length adjustment circuit 44$^{(n)}$ is supplied to the multiplying circuit 47$^{(n)}$, the amplitude characteristics exhibited by such a configuration (hereafter, the circuit will be referred to as a comb filter) have peaks at regular intervals in the frequency axis direction. In other words, the comb filter has a plurality of resonance frequencies. The resonance frequencies are arranged at regular intervals in the frequency axis direction in an amplitude characteristic diagram. As indicated in FIG. 7, however, the frequencies of overtones of a musical sound of an acoustic piano are slightly higher than frequencies of integral multiples of a frequency f0 of a fundamental tone. Furthermore, the amount of deviation increases in higher tones. In order to express such an inharmonic component of the musical sound of the acoustic piano, the first inharmonic component generation circuit 45$^{(n)}$ and the second inharmonic component generation circuit 46$^{(n)}$ are provided.

Figure 8:
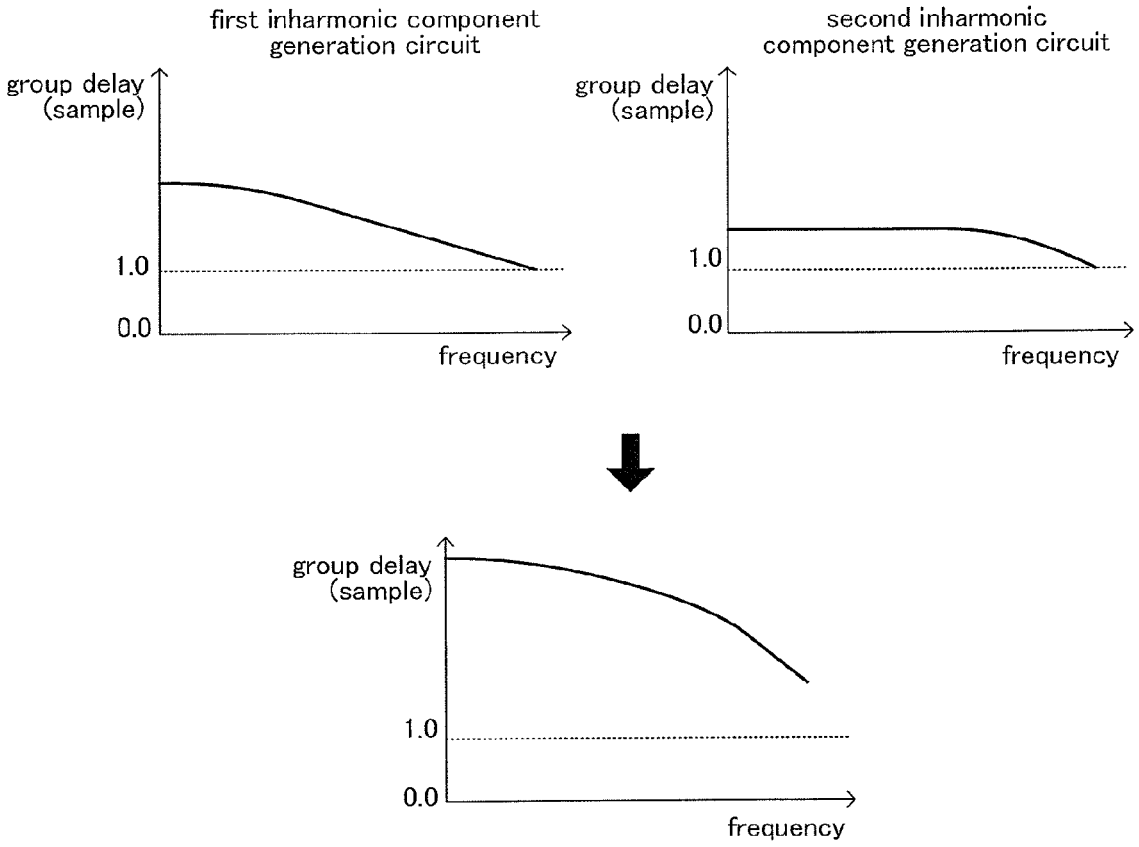
FIG. 8 is an explanatory diagram showing an example in which the first inharmonic component generation circuit and the second inharmonic component generation circuit are used to configure an inharmonic component generation circuit having desired group delay characteristics.

The gain (the first inharmonic component setting data G1$^{(n)}$) of the multiplying circuit 453$^{(n)}$ and the multiplying circuit 454$^{(n)}$, and the gain (the second inharmonic component setting data G2$^{(n)}$) of the multiplying circuit 463$^{(n)}$ and the multiplying circuit 464$^{(n)}$ are specified so that assuming that the first inharmonic component generation circuit 45$^{(n)}$ and the second inharmonic component generation circuit 46$^{(n)}$ are considered as one inharmonic component setting circuit, its group delay characteristics have desired characteristics (see FIG. 8). For example, the gain (the first inharmonic component setting data G1$^{(n)}$) of the multiplying circuit 453$^{(n)}$ and the multiplying circuit 454$^{(n)}$, and the gain (the second inharmonic component setting data G2$^{(n)}$) of the multiplying circuit 463$^{(n)}$ and the multiplying circuit 464$^{(n)}$ are specified such that the group delay characteristics of the first inharmonic component generation circuit 45$^{(n)}$ and the second inharmonic component generation circuit 46$^{(n)}$ are included in an area "B" of FIG. 6. In this case, as indicated in FIG. 8, the higher the frequency is, the smaller the group delay is. In addition, the lower the frequency is, the greater the group delay is. More specifically, the inharmonic component setting circuits can lower the respective frequencies of the peaks arranged in regular intervals in the frequency axis direction in the amplitude characteristic diagram of the comb filter. Furthermore, the frequency of the peaks belonging to a low frequency area varies more than the frequency of the peaks belonging to a high frequency area.

First of all, therefore, the delay length data DL$^{(n)}$ and the delay length adjustment data DA$^{(n)}$ are specified so that the peaks shown in the amplitude characteristic diagram of the comb filter are situated on the high frequency side rather than the peaks on the amplitude characteristic diagram of a musical sound indicated by a digital musical tone signal generated by the tone generator 16 in response to a depression of a key number "n". In the following description, a musical sound indicated by a digital musical tone signal generated in response to a depression of a key number "n" (generated in accordance with tone generation instruction information including the key number n) included in musical sounds indicated by digital musical tone signals supplied from the tone generator 16 will be represented as a musical sound PS$^{(n)}$. The gain (the first inharmonic component setting data G1$^{(n)}$) of the multiplying circuit 453$^{(n)}$ and the multiplying circuit 454$^{(n)}$, and the gain (the second in harmonic component setting data G2$^{(n)}$) of the multiplying circuit 463$^{(n)}$ and the multiplying circuit 464$^{(n)}$ are specified so that the amplitude characteristics of the comb filter to which the inharmonic component setting circuits are applied coincide with the amplitude characteristics of the musical sound PS$^{(n)}$ (that is, so that resonance frequencies of the resonance tone generation circuit 30$^{(n)}$ coincide with frequencies of the fundamental tone and overtones of the musical sound PS$^{(n)}$). Furthermore, it is preferable that a difference between the resonance frequencies of the resonance tone generation circuit 30$^{(n)}$ and the frequencies of the fundamental tone and the overtone of the musical sound PS$^{(n)}$ is a predetermined threshold value (1 Hz, for instance), or lower.

The panning setting circuit 50$^{(n)}$ has a multiplying circuits 50L$^{(n)}$ and 50R$^{(n)}$. The multiplying circuits 50L$^{(n)}$ and 50R$^{(n)}$ retrieve sample values from different delay elements, respectively, of the plurality of delay elements which make up the delay circuit 43$^{(n)}$ (see FIG. 4). The multiplying circuits 50L$^{(n)}$ and 50R$^{(n)}$ multiply the sample values retrieved from the delay circuit 43$^{(n)}$ by a predetermined coefficient, respectively, and supply the multiplied results to the adding portion 70. The predetermined coefficient is specified so that the panning of a resonance tone generated by the resonance tone generation circuit 30$^{(n)}$ coincides with the panning of the musical sound PS$^{(n)}$.

An index of the delay element connected to the multiplying circuit 50L$^{(n)}$ of the panning setting circuit 50$^{(n)}$ is different from an index of the delay element connected to the multiplying circuit 50L$^{(m\neq n)}$ of a different panning setting circuit 50$^{(m\neq n)}$. An index of the delay element connected to the multiplying circuit 50R$^{(n)}$ of the panning setting circuit 50$^{(n)}$ is different from an index of the delay element connected to the multiplying circuit 50R$^{(m\neq n)}$ of a different panning setting circuit 50$^{(m\neq n)}$. Furthermore, the resonance tone generation apparatus 20 may be configured such that an index of the delay element connected to the multiplying circuit 50 L$^{(n)}$ of at least one panning setting circuit 50$^{(n)}$ of the panning setting circuits 50$^{(n)}$ is different from an index of the delay element connected to the multiplying circuit 50 L$^{(m)}$ of at least one panning setting circuit 50$^{(n)}$) of the other panning setting circuits 50$^{(m\neq n)}$. Furthermore, the resonance tone generation apparatus 20 may be configured such that an index of the delay element connected to the multiplying circuit 50 R$^{(n)}$ of at least one panning setting circuit 50$^{(n)}$ of the panning setting circuits 50$^{(n)}$ is different from an index of the delay element connected to the multiplying circuit 50 R$^{(n)}$ of at least one panning setting circuit 50$^{(m)}$ of the other panning setting circuits 50$^{(m\neq n)}$. For example, the multiplying circuits 50L$^{(n)}$ for bass range ("C3" or lower, for example) and treble range ("C6" or higher, for example) may be connected to the delay elements having the same index, with the multiplying circuits 50L$^{(n)}$ for midrange being connected to the delay elements having an index which is different from the index for the bass and treble ranges. For example, furthermore, the multiplying circuits 50R$^{(n)}$ for bass range and treble range may be connected to the delay elements having the same index, with the multiplying circuits 50$R^{(n)}$ for midrange being connected to the delay elements having an index which is different from the index for the bass and treble ranges.

Figure 9:
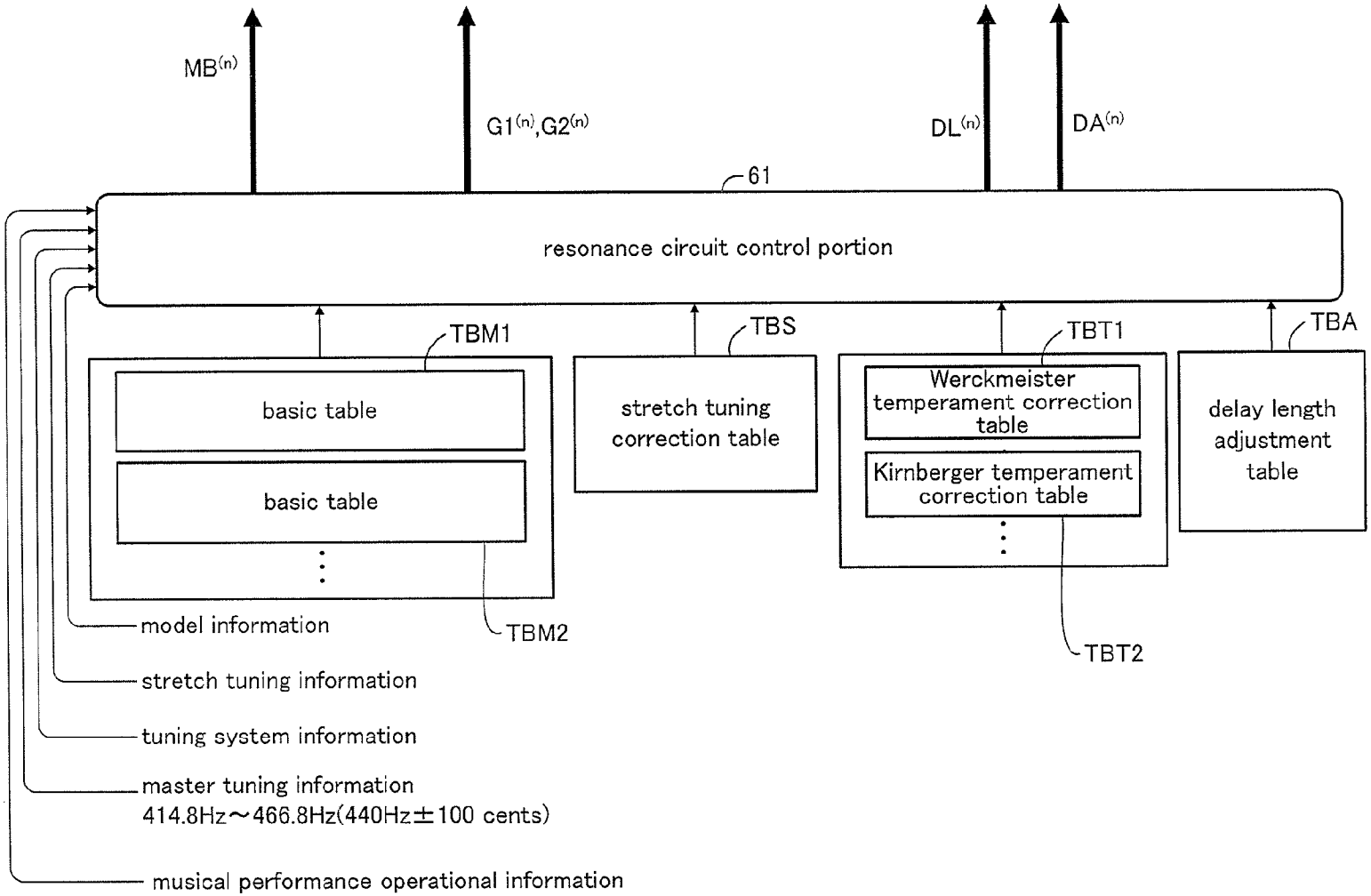
FIG. 9 is a block diagram showing a configuration of a resonance circuit setting portion shown in FIG. 2.

Next, the configuration of the resonance circuit setting portion 60 will be explained. The resonance circuit setting portion 60 has a resonance circuit control portion 61 as indicated in FIG. 9. The resonance circuit control portion 61 generates resonance circuit setting information in accordance with musical performance operational information and musical sound setting information supplied from the CPU 12*a*, and supplies the generated information to the resonance tone generation circuits 30$^{(n)}$.

More specifically, the resonance circuit control portion 61 generates open close data $MB^{(n)}$ in accordance with the musical performance operational information supplied from the CPU 12*a*, and supplies the generated data to the resonance tone generation circuits 30$^{(n)}$. The resonance circuit control portion 61 supplies "1" to the resonance tone generation circuit 30$^{(n)}$ corresponding to the key number n of a key which is being depressed and is included in the keys which make up the keyboard apparatus. Furthermore, the resonance circuit control portion 61 supplies "0" to the resonance tone generation circuit 30$^{(n)}$ corresponding to the key number n of a key which is being released. However, if the damper pedal is being depressed, the resonance circuit control portion 61 supplies "1" to all the resonance tone generation circuits 30$^{(n)}$ regardless of whether the corresponding keys are being depressed or released.

In accordance with the musical sound setting information supplied from the CPU 12*a*, furthermore, the resonance circuit control portion 61 generates delay length data $DL^{(n)}$, delay length adjustment data $DA^{(n)}$, first inharmonic component setting data $G1^{(n)}$ and second inharmonic component setting data $G2^{(n)}$ (hereafter referred to as resonance frequency information), and supplies the data to the resonance tone generation circuits 30$^{(n)}$ as explained below.

Figures 10, 11:
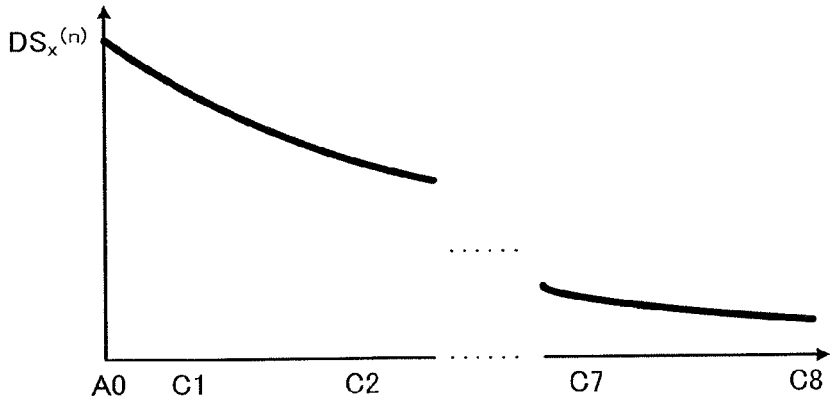
FIG. 10 is a table showing a configuration of a basic table.
FIG. 11 is a graph showing the number of delay samples which make up the basic table.

The resonance circuit setting portion 60 has basic tables TBM1, TBM2, . . . . The basic table TBM1 is a table for the model M1, while the basic table TBM2 is a table for the model M2. The basic tables TBM1, TBM2, . . . are configured the same. Hereafter, a configuration of the basic table TBMx for the model Mx (x=1, 2, . . . ) will be explained. As indicated in FIG. 10, the basic table TBMx is composed of the number of delay samples $DS_x^{(n)}$, the first inharmonic component setting data $G1_x^{(n)}$, and the second inharmonic component setting data $G2_x^{(n)}$ of the resonance tone generation circuit 30$^{(n)}$ in a case where the model Mx is selected, with certain settings on tuning (more specifically, temperament is equal temperament, master tuning is "440 Hz", and stretch tuning is not employed). The number of delay samples $DS_x^{(n)}$ is used for generation of delay length data $DL_x^{(n)}$ and delay length adjustment data $DA_x^{(n)}$, as explained in detail later.

The number of delay samples $DS_x^{(n)}$ is a value proportional to a reciprocal of the frequency of the key number n in equal temperament, as indicated in FIG. 11. The number of delay samples $DS_x^{(n)}$ has an integer portion and a decimal portion. Using the number of delay samples DSP), the resonance circuit control portion 61 generates the delay length data $DL_x^{(n)}$ and the delay length adjustment data $DA_x^{(n)}$ which are to be supplied to the resonance tone generation circuit 30$^{(n)}$. More specifically, the resonance circuit control portion 61 supplies the integer portion of the number of delay samples $DS^{(n)}$ as the delay length data $DL_x^{(n)}$ to the resonance tone generation circuit 30$^{(n)}$. The delay length adjustment data $DA_x^{(n)}$ is determined in accordance with a delay length adjustment table TBA which will be explained next.

Figures 12, 13:
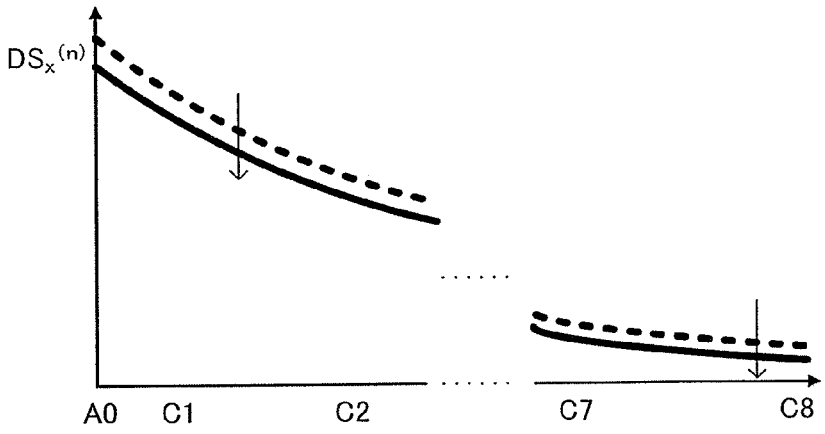
FIG. 12 is a table showing a configuration of a delay length adjustment table.
FIG. 13 is a graph showing the number of delay samples corrected as a result of changing master tuning.

The delay length adjustment table TBA is composed of delay length adjustment data $DA_{(0.0)}$, $DA_{(0.1)}$, $DA_{(0.9)}$ corresponding to a value fp(fp="0.0", "0.1", . . . , "0.9") of the decimal portion as indicated in FIG. 12. The resonance circuit control portion 61 supplies delay length adjustment data $DA_{(fp)}$ corresponding to the value fp of the decimal portion of the number of delay samples $DS_x^{(n)}$ as the delay length adjustment data $DA_x^{(n)}$ to the resonance tone generation circuit 30$^{(n)}$.

The number of delay samples $DS_x^{(n)}$, the first inharmonic component setting data $G1_x^{(n)}$, the second inharmonic component setting data $G2_x^{(n)}$, and the delay length adjustment data $DA_{(0.0)}$, $DA_{(0.1)}$, . . . , $DA_{(0.9)}$ are specified so that the frequencies of the fundamental tone and overtones of the musical sound $PS^{(n)}$ of a case where the model $Mx_{(=1, 2, \ldots)}$ is selected with the tuning being set to the above-described certain settings coincide with the resonance frequencies of the resonance tone generation circuit 30$^{(n)}$.

The frequencies of the fundamental tone and overtones of the musical sound $PS^{(n)}$ of a case where the model $Mx_{(=1, 2, \ldots)}$ is selected, but the set tuning is not the above-described certain settings are different from frequencies of the fundamental tone and overtones of the musical sound $PS^{(n)}$ of the case where the tuning is set to the above-described certain settings. Therefore, the resonance circuit control portion 61 corrects the resonance frequencies of the resonance tone generation circuit 30$^{(n)}$ as follows.

In a case where the master tuning is not "440 Hz", the resonance circuit control portion 61 corrects the value of the number of delay samples $DS_x^{(n)}$ as follows. Hereafter, if the master tuning is represented as "fc", a correction coefficient $\alpha$ is to be represented as "440/fc". The resonance circuit control portion 61 multiplies the correction coefficient $\alpha$ by the number of delay samples $DS_x^{(n)}$. As a result, the number of delay samples $DS_x^{(n)}$ increases or decreases. More specifically, if the master tuning is greater than "440 Hz", the number of delay samples $DS_x^{(n)}$ decreases (see FIG. 13). If the master tuning is smaller than "440 Hz", the number of delay samples $DS_x^{(n)}$ increases. As a result, the resonance frequencies of the resonance tone generation circuit 30$^{(n)}$ coincide with the frequencies of the fundamental tone and overtones of the musical sound $PS^{(n)}$ of a case where the master tuning is "fc".

Figures 14, 15:
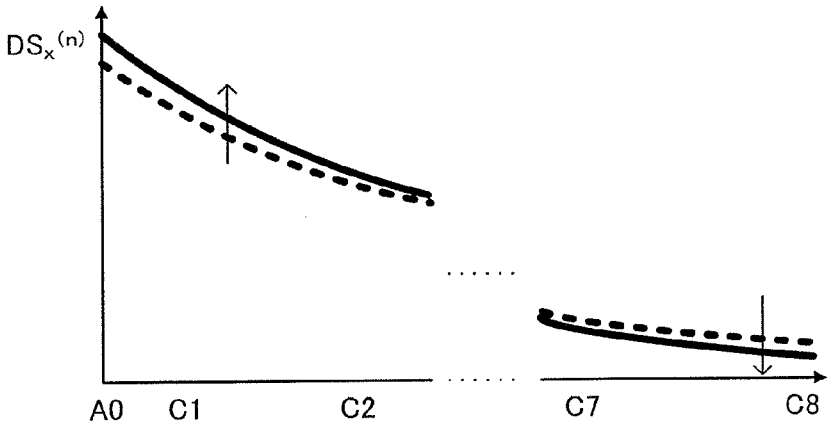
FIG. 14 is a table showing a configuration of a stretch tuning correction table.
FIG. 15 is a graph showing the number of delay samples corrected as a result of employing stretch tuning.

In a case where the employment of the stretch tuning is selected, the resonance circuit control portion 61 corrects the value of the number of delay samples $DS_x^{(n)}$ as follows, using a stretch tuning correction table TBS which will be explained below. The stretch tuning correction table TBS is composed of correction coefficients $wt^{(A0)}$, $wt^{(A\#0)}$, . . . , $wt^{(C8)}$ as indicated in FIG. 14. The correction coefficient $wt^{(n)}$ is proportional to a reciprocal of a value obtained by dividing the frequency of the musical sound $PS^{(n)}$ of a case where the stretch tuning is employed by the frequency of the musical sound $PS^{(n)}$ of a case where the stretch tuning is not employed. The resonance circuit control portion 61 multiplies the correction coefficient $wt^{(n)}$ by the number of delay samples $DS_x^{(n)}$. As a result, the number of delay samples in the bass is increased, while the number of delay samples in the treble is decreased (see FIG. 15). Resultantly, the resonance frequencies of the resonance tone generation circuits 30$^{(n)}$ in the bass are lowered, while the resonance frequencies of the resonance tone generation circuits 30$^{(n)}$ in the treble are raised. As a result, the resonance frequencies of the resonance tone generation circuit 30$^{(n)}$ coincide with the frequencies of the fundamental tone and overtones of the musical sound $PS^{(n)}$ of a case where the stretch tuning is employed.

Figures 16, 17:
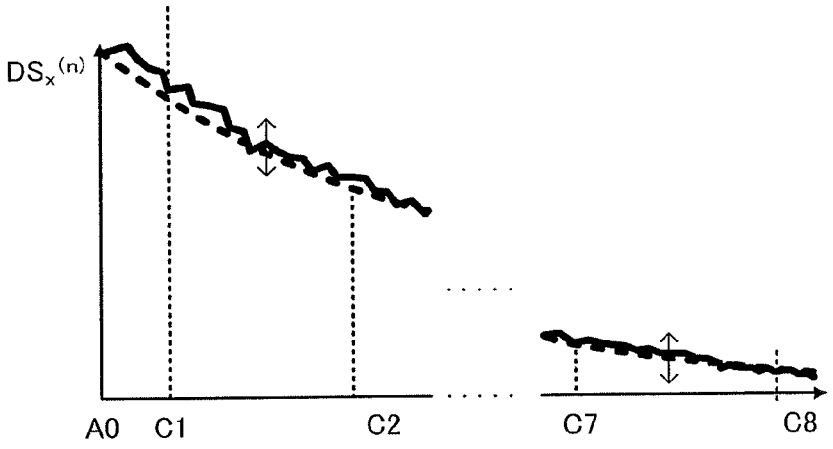
FIG. 16 is a table showing a configuration of a temperament correction table.
FIG. 17 is a graph showing the number of delay samples corrected as a result of selecting a temperament which is different from equal temperament.

In a case where a temperament other than equal temperament is selected, the resonance circuit control portion 61 corrects the value of the number of delay samples $DS_x^{(n)}$ as follows, using a temperament correction table TBTy. The temperament correction tables TBTy are provided to correspond to temperaments Ty(y=1, 2, . . . ). For example, a temperament T1 is Werckmeister temperament, while a temperament T2 is Kirnberger temperament. The temperament correction table TBTy is composed of correction coefficients $wp_y^{(C)}$, $wp_y^{(C\#)}$, . . . , $wp_y^{(B)}$ provided for respective pitch classes pc as indicated in FIG. 16. A correction coefficient $wp_y^{(pc)}$ is proportional to a reciprocal of a frequency deviation between the frequency of a pitch class pc of a case where the temperament Ty is employed and the frequency of the pitch class pc of a case where the equal temperament is employed. The resonance circuit control portion 61 multiplies each of the correction coefficients $wp_y^{(C)}$, $wp_y^{(C\#)}$, . . . , $wp_y^{(B)}$ by the number of delay sample having a corresponding pitch class pc included in the number of delay samples $DS_x^{(A0)}$, $DS_x^{(A\#0)}$, . . . , $DS_x^{(C8)}$. As a result, the number of delay samples $DS_x^{(n)}$ is increased or decreased in accordance with deviation between the key number n of the case where the temperament Ty is employed and the key number n of the case where the equal temperament is employed (see FIG. 17). As a result, the resonance frequencies of the resonance tone generation circuit $\mathbf{30}^{(n)}$ coincide with the frequencies of the fundamental tone and overtones of the musical sound $PS^{(n)}$ of the case where the temperament Ty is selected.

The adding portion 70 adds sample values making up left channel signals of a resonance tone and sample values making up right channel signals of the resonance tone to a sample value making up a left channel signal of the musical sound and a sample value making up a right channel signal of the musical sound, respectively, and supplies the added sample values to the sound system 17.

Figure 18:
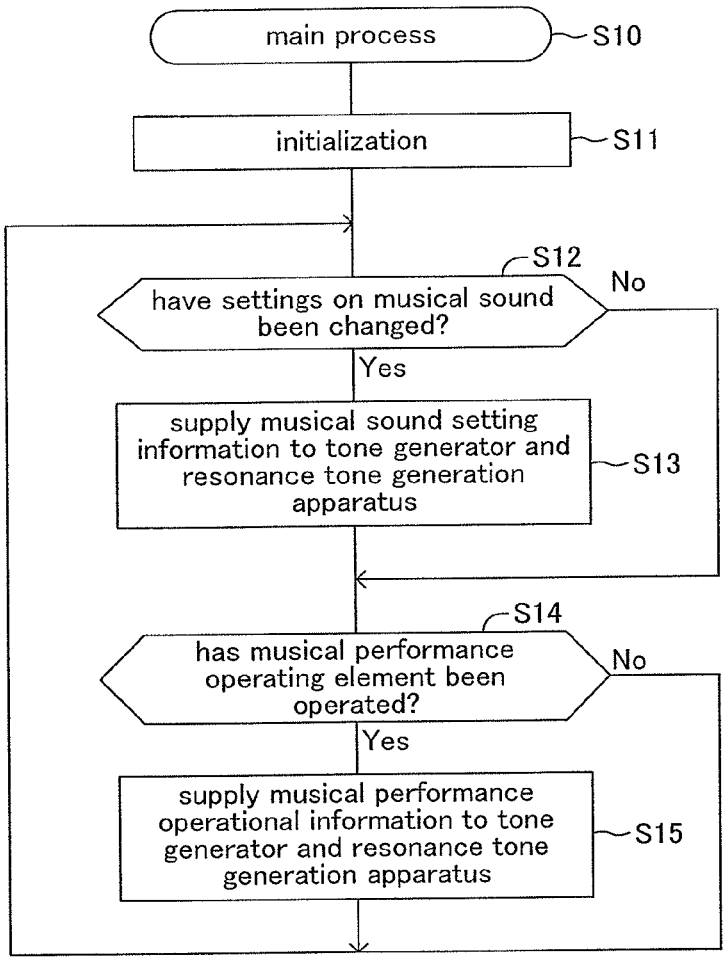
FIG. 18 is a flowchart of a main program.

Next, the behavior of the electronic musical instrument DM configured as above will be explained. If a user turns on the power of the electronic musical instrument DM, the CPU 12*a* reads out a main program indicated in FIG. 18 from the ROM 12*b*, and carries out the program. At step S10, the CPU 12*a* starts a main process. At step S11, the CPU 12*a* executes an initialization process. For instance, the CPU 12*a* selects the tone color of the piano model M1. Furthermore, the CPU 12*a* initializes settings on tuning. More specifically, the CPU 12*a* sets the temperament to equal temperament, and sets the master tuning to "440 Hz". Furthermore, the CPU 12*a* selects a state where the stretch tuning is not employed. Then, the CPU 12*a* supplies an operation start signal to the resonance tone generation apparatus 20. The behavior of the resonance tone generation apparatus 20 will be explained later.

Next, the CPU 12*a* judges at step S12 whether settings on musical sound have been changed or not. If the settings on musical sound have not been changed, the CPU 12*a* determines "No", and proceeds to step S14 which will be explained later. If the settings on musical sound have been changed, the CPU 12*a* determines "Yes", and proceeds to step S13 to supply musical sound setting information indicative of the content of the changed settings to the tone generator 16 and the resonance tone generation apparatus 20. Then, the CPU 12*a* judges at step S14 whether or not the musical performance operating element has been operated. If the musical performance operating element has not been operated, the CPU 12*a* determines "No", and proceeds to the above-described step S12. If the musical performance operating element has been operated, the CPU 12*a* determines "Yes", supplies musical performance operational information to the tone generator 16 and the resonance tone generation apparatus 20 at step S15, and then proceeds to the above-described step S12.

Figure 19:
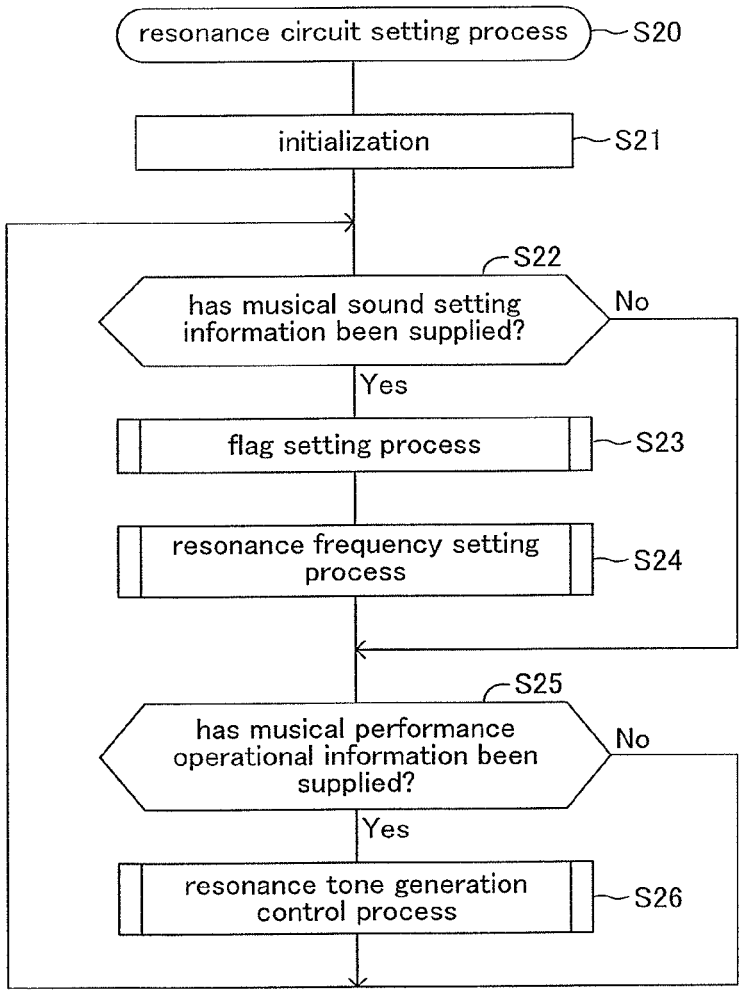
FIG. 19 is a flowchart of a resonance circuit setting program.

Next, the behavior of the resonance tone generation apparatus 20 will be explained. In response to supply of the operation start signal to the resonance tone generation apparatus 20 from the CPU 12*a*, the resonance circuit control portion 61 carries out a resonance circuit setting process indicated in FIG. 19. At step S20, the resonance circuit control portion 61 starts the resonance circuit setting process. At step S21, the resonance circuit control portion 61 sets a model flag FM indicative of a currently selected model to "1" indicating that the model M1 is being selected. Furthermore, the resonance circuit control portion 61 sets a stretch tuning flag FS indicating whether the stretch tuning is to be employed or not to "0" indicating that the stretch tuning is not to be employed. Furthermore, the resonance circuit control portion 61 sets a temperament flag FT representative of a currently selected temperament to "0" indicating that the equal temperament is being selected. Furthermore, the resonance circuit control portion 61 sets the correction coefficient α to "1".

Then, the resonance circuit control portion 61 initializes the resonance tone generation circuits $\mathbf{30}^{(n)}$, using the basic table TBM1 and the delay length adjustment table TBA. More specifically, the resonance circuit control portion 61 supplies the integer portion of the number of delay samples $DS_1^{(n)}$ to the resonance tone generation circuits $\mathbf{30}^{(n)}$ as delay length data $DL_1^{(n)}$. On the basis of the value fp of the decimal portion of the number of delay samples $DS_1^{(n)}$, furthermore, the resonance circuit control portion 61 selects one of the delay length adjustment data sets $DA_{(0.0)}$, $DA_{(0.1)}$, . . . , $DA_{(0.9)}$, and supplies the selected data to the resonance tone generation circuits $\mathbf{30}^{(n)}$ as delay length adjustment data $DA_1^{(n)}$. Furthermore, the resonance circuit control portion 61 supplies the first inharmonic component setting data $G\mathbf{1}_1^{(n)}$ and the second inharmonic component setting data $G\mathbf{2}_1^{(n)}$ to the resonance tone generation circuits $\mathbf{30}^{(n)}$.

Figure 20:
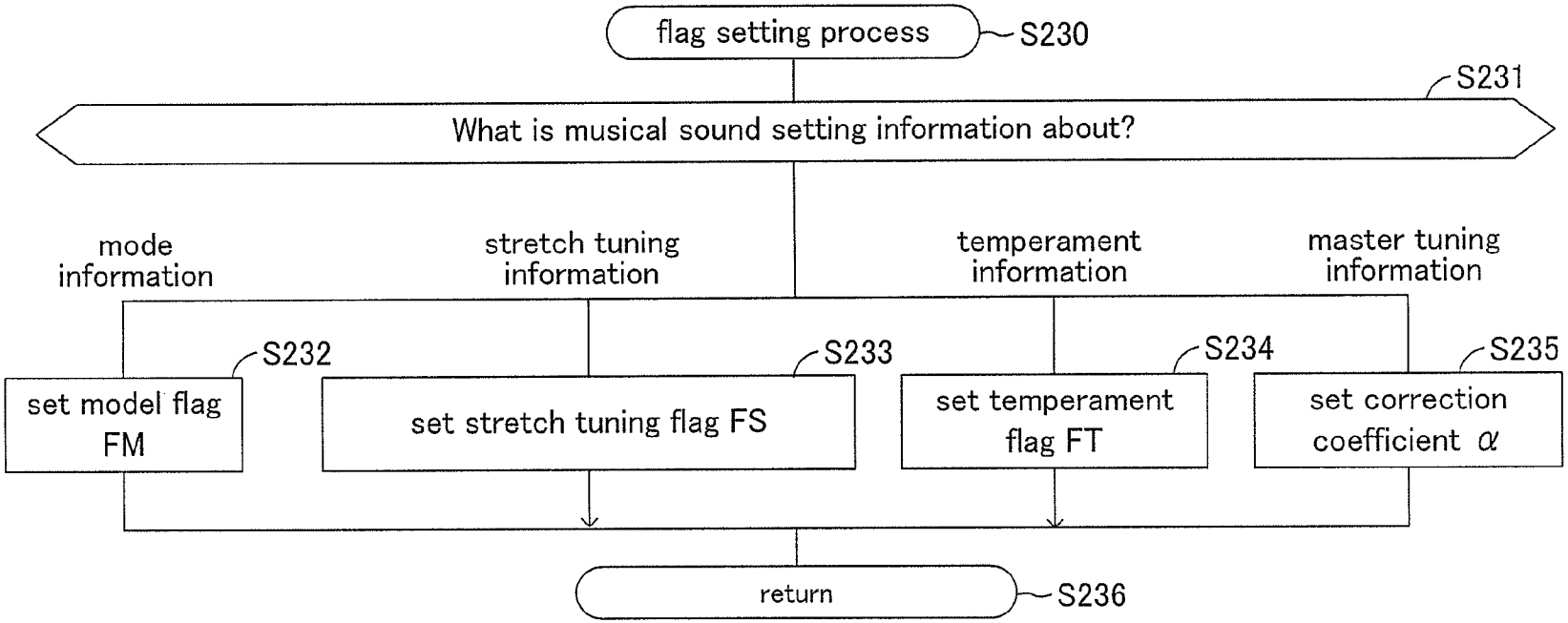
FIG. 20 is a flowchart of a flag setting program.

Then, the resonance circuit control portion 61 judges at step S22 whether or not the musical sound setting information has been supplied from the CPU 12*a*. If the musical sound setting information has not been supplied, the resonance circuit control portion 61 determines "No", and proceeds to step S25. If the musical sound setting information has been supplied, the resonance circuit control portion 61 determines "Yes", and carries out a flag setting process indicated in FIG. 20 at step S23. At step S230, the resonance circuit control portion 61 starts the flag setting process. At step S231, the resonance circuit control portion 61 determines a process to be done next in accordance with the supplied information. In a case where the model information has been supplied, the resonance circuit control portion 61 sets the model flag FM as follows at step S232. In a case where the model information indicates a model Mx, the resonance circuit control portion 61 sets the model flag FM to "x".

In a case where the stretch tuning information has been supplied, the resonance circuit control portion 61 sets the stretch tuning flag FS as follows at step S233. In a case where the stretch tuning information indicates that the stretch tuning is not to be employed, the stretch tuning flag FS is set to "0". In a case where the stretch tuning information indicates that the stretch tuning is to be employed, the stretch tuning flag FS is set to "1".

In a case where the temperament information has been supplied, the resonance circuit control portion 61 sets the temperament flag FT as follows at step S234. In a case where the temperament information indicates the temperament Ty, the temperament flag FT is set to "y". In a case where the temperament information indicates the equal temperament, the temperament flag FT is set to "0".

Furthermore, in a case where the master tuning information has been supplied, the resonance circuit control portion 61 sets the correction coefficient α as follows at step S235. In a case where the master tuning indicated by the master tuning information is "fc", the correction coefficient α is set to "440/fc". Then, the resonance circuit control portion 61 terminates the flag setting process at step S236, and proceeds to step S24 of the resonance circuit setting process.

Figure 21:
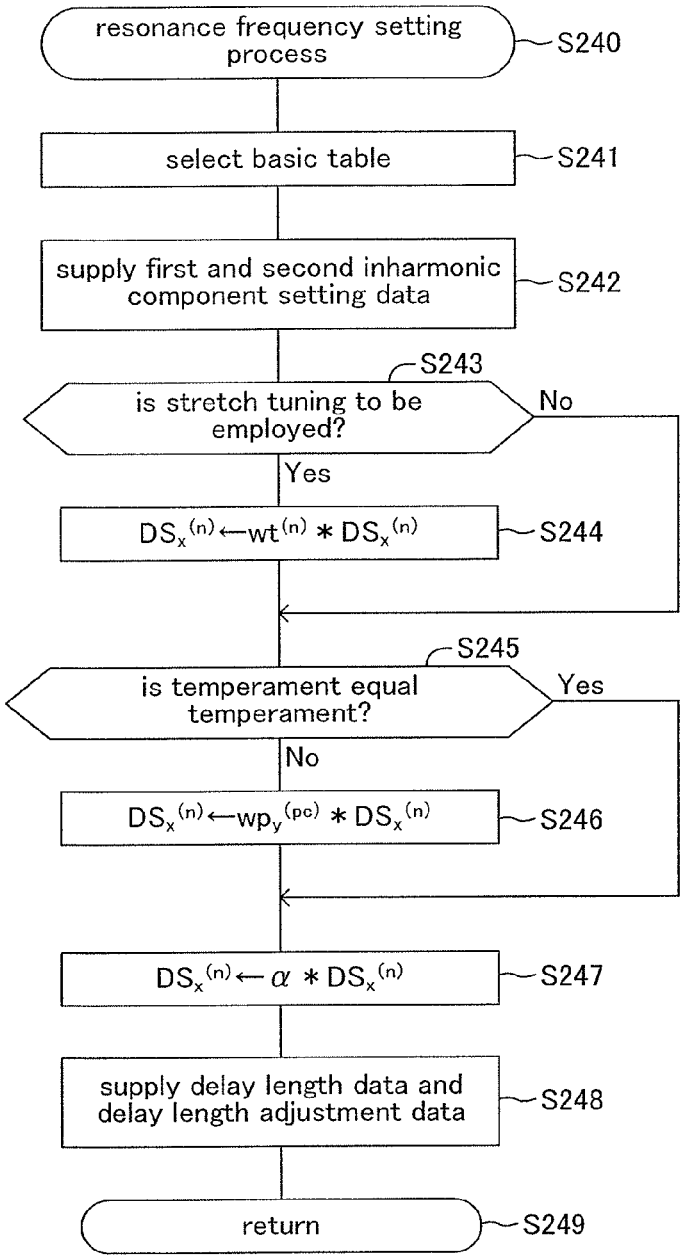
FIG. 21 is a flowchart of a resonance frequency setting program.

Then, the resonance circuit control portion 61 carries out a resonance frequency setting process shown in FIG. 21 at step S24. At step S240, the resonance circuit control portion 61 starts the resonance frequency setting process. At step S241, the resonance circuit control portion 61 selects one of the basic tables TBM1, TBM2, . . . , in accordance with the value of the model flag FM. In a case where the model flag FM is "x", the basic table TBM x is selected. Next, at step S242, the resonance circuit control portion 61 retrieves the first inharmonic component setting data $G1_x^{(n)}$ and the second inharmonic component setting data $G2_x^{(n)}$ from the selected basic table TBMx, and supplies the retrieved data to the resonance tone generation circuits $30^{(n)}$.

Then, at step S243, the resonance circuit control portion 61 judges whether the stretch tuning is to be employed or not, using the value of the stretch tuning flag FS. If the stretch tuning flag FS is "0", the resonance circuit control portion 61 determines "No", and proceeds to step S245 which will be explained later. If the stretch tuning flag FS is "1", the resonance circuit control portion 61 determines "Yes", and proceeds to step S244 to retrieve the correction coefficient $wt^{(n)}$ from the stretch tuning correction table TBS to multiply the retrieved correction coefficient $wt^{(n)}$ by the number of delay samples $DS_x^{(n)}$ to correct the respective numbers of delay samples $DS_x^{(n)}$.

Then, at step S245, the resonance circuit control portion 61 judges whether or not the equal temperament has been selected as temperament, using the value of the temperament flag FT. If the temperament flag FT is "0", the resonance circuit control portion 61 determines "Yes", and proceeds to step S247 which will be explained later. If the temperament flag FT is "1" or greater, the resonance circuit control portion 61 determines "No", and selects one of the correction tables TBT1, TBT2, . . . in accordance with the value of the temperament flag FT at step S246. More specifically, in a case where the temperament flag FT is "y", the resonance circuit control portion 61 selects the temperament correction table TBTy. Then, the resonance circuit control portion 61 retrieves the correction coefficients $wp_y^{(C)}$, $wp_y^{(C\#)}$, . . . , $wp_y^{(B)}$ from the selected temperament correction table TBTy to multiply each of the retrieved correction coefficients by the number of delay samples having a corresponding pitch class pc included in the numbers of delay samples $DS_x^{(A0)}$, $DS_x^{(A\#0)}$, $DS_x^{(C8)}$ to correct the respective numbers of delay samples DSP).

Then, the resonance circuit control portion 61 corrects the respective numbers of delay samples $DS_x^{(n)}$ by multiplying the correction coefficient α by the number of delay samples $DS_x^{(n)}$ at step S247.

Then, the resonance circuit control portion 61 supplies the integer portion of the number of delay samples $DS_x^{(n)}$ to the resonance tone generation circuit $30^{(n)}$ as the delay length data $DL_x^{(n)}$ at step S248. Furthermore, the resonance circuit control portion 61 supplies the delay length adjustment data $DA_{(fp)}$ corresponding to the value fp of the decimal portion of the number of delay samples $DS_x^{(n)}$ to the resonance tone generation circuit $30^{(n)}$ as the delay length adjustment data $DA_x^{(n)}$. The resonance circuit control portion 61 terminates the resonance frequency setting process at step S249, and proceeds to step S25 of the resonance circuit setting process.

Figure 22:
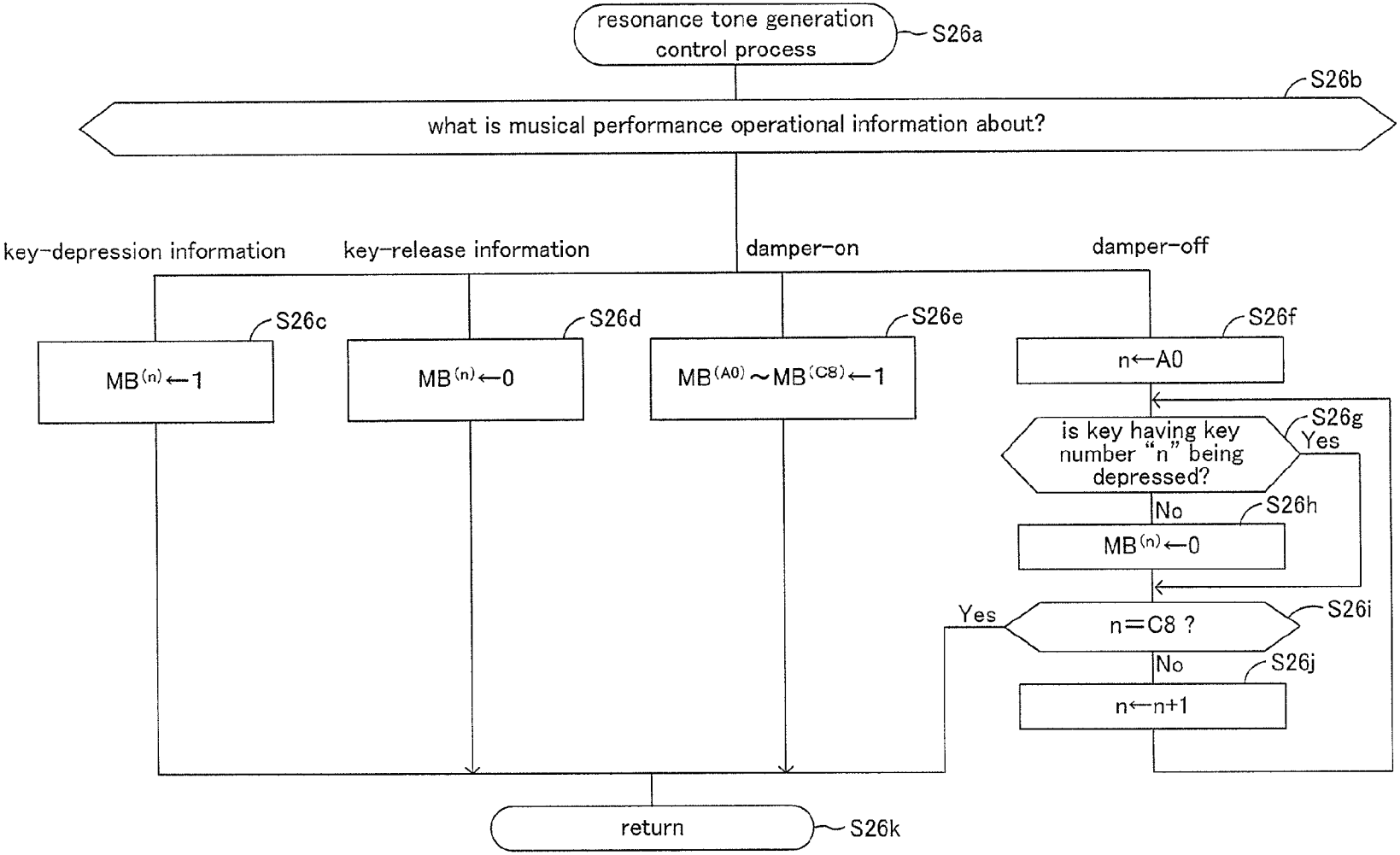
FIG. 22 is a flowchart of a resonance tone generation control program.

At step S25, the resonance circuit control portion 61 judges whether or not the musical performance operational information has been supplied from the CPU 12*a*. If the musical performance operational information has not been supplied, the resonance circuit control portion 61 determines "No", and proceeds to step S22. If the musical performance operational information has been supplied, the resonance circuit control portion 61 determines "Yes", and carries out a resonance tone generation control process indicated in FIG. 22 at step S26. The resonance circuit control portion 61 starts the resonance tone generation control process at step S26*a*. At step S26*b*, the resonance circuit control portion 61 then determines a process to be done next in accordance with the supplied musical performance operational information. In a case where the musical performance operational information indicating that the key having the key number n was depressed has been supplied, the resonance circuit control portion 61 supplies "1" as the open close data $MB^{(n)}$ to the resonance tone generation circuit $30^{(n)}$ at step S26*c*. The supply of "1" as the open close data $MB^{(n)}$ enables supply of a sample value from the reception circuit $41^{(n)}$ to later circuits. In other words, the supply of "1" as the open close data $MB^{(n)}$ turns the resonance tone generation circuit $30^{(n)}$ to a state where the resonance tone generation circuit $30^{(n)}$ can generate a resonance tone.

In a case where the musical performance operational information indicative of the release of the key having the key number n has been supplied, the resonance circuit control portion 61 supplies "0" as the open close data $MB^{(n)}$ to the resonance tone generation circuit $30^{(n)}$ at step S26*d*. In a case where the damper pedal is being depressed, however, the resonance circuit control portion 61 proceeds to step S26*k* which will be explained later without executing the step S26*d*. The supply of "0" as the open close data $MB^{(n)}$ prevents supply of a sample value from the reception circuit $41^{(n)}$ to later circuits. In other words, the supply of "0" as the open close data $MB^{(n)}$ turns the resonance tone generation circuit $30^{(n)}$ to a state where the resonance tone generation circuit $30^{(n)}$ cannot generate resonance tones.

In a case where the musical performance operational information indicative of the depression of the damper pedal was supplied, the resonance circuit control portion 61 supplies "1" as the open close data $MB^{(n)}$ to all the resonance tone generation circuits $30^{(n)}$ at step S26*e*.

In a case where the musical performance operational information indicative of the release of the damper pedal was supplied, the resonance circuit control portion 61 sets the key number n to "A0" at step S26*f*. The resonance circuit control portion 61 then judges at step S26*g* whether the key having the key number n is being depressed or not. If the key having the key number n is being depressed, the resonance circuit control portion 61 determines "Yes", and proceeds to step S26*i*. If the key having the key number n is being released, the resonance circuit control portion 61 determines "No", and supplies "0" as the open close data $MB^{(n)}$ to the resonance tone generation circuit $30^{(n)}$ at step S26*h*. At step S26*i*, the resonance circuit control portion 61 judges whether the key number n is "C8" or not. In a case where the key number n is "B7" or lower, the resonance circuit control portion 61 determines "No", and increments the key number n at step S26*j* to proceed to step S26*g*. In a case where the key number n is "C8", the resonance circuit control portion 61 determines "Yes", terminates the resonance tone generation control process at step S26*k*, and proceeds to step S22 of the resonance circuit setting process.

In this embodiment, as described above, resonance frequencies of the resonance tone generation circuit $30^{(n)}$ are determined in accordance with the selected tone color (model), temperament, master tuning and the like. More specifically, this embodiment is designed such that the resonance frequencies of the resonance tone generation circuit 30$^{(n)}$ coincide with the frequencies of the fundamental tone and overtones of the musical sound PS$^{(n)}$ supplied from the tone generator 16. Therefore, this embodiment prevents occasions where sounds are mudded, or the resonance tone generation circuits 30$^{(n)}$ are unable to resonate well due to deviation between the frequencies of the fundamental tone and overtones of the musical sound PS$^{(n)}$ supplied from the tone generator 16, and the frequencies of the resonance tone generation circuit 30$^{(n)}$. Therefore, the electronic musical instrument DM to which the resonance tone generation apparatus 20 is applied can more faithfully imitate different models of acoustic pianos and acoustic pianos each having different settings on tuning.

Furthermore, if the settings on tuning of the electronic musical instrument DM are set to certain settings, the basic table TBMx is used to specify the respective resonance frequencies of the resonance tone generation circuits 30$^{(n)}$. If the settings on temperament and/or stretch tuning are set to settings which are different from the above-described certain settings, the temperament correction table TBTy and/or the stretch tuning correction table TBS are used to correct the number of delay samples $DS_x^{(n)}$ which form the basic table TBMx. Furthermore, if the settings on master tuning are set to settings which are different from the above-described certain settings, the correction coefficient $\alpha$ is calculated to multiply the correction coefficient $\alpha$ by the number of delay samples $DS_x^{(n)}$ which form the basic table TBMx to correct the number of delay samples $DS_x^{(n)}$. According to this embodiment, therefore, respective configurations of the tables can be simplified, compared to a case where resonance frequency setting information which is to be supplied to the resonance tone generation circuits 30$^{(n)}$ is provided for each setting on tuning of the electronic musical instrument DM.

In this embodiment, furthermore, the multiplication coefficient of the multiplying circuits 50L$^{(n)}$ and 50R$^{(n)}$ is set so that the panning of a resonance tone generated by the resonance tone generation circuit 30$^{(n)}$ coincides with the panning of the musical sound PS$^{(n)}$. As a result, this embodiment can imitate the panning of resonance tones of an acoustic piano.

To the multiplying circuits 50L$^{(n)}$ and 50R$^{(n)}$ of the panning setting circuit 50$^{(n)}$, sample values are supplied from different delay elements, respectively, included in the delay elements which form the delay circuit 43$^{(n)}$. More specifically, the time elapsed since the sample value which is to be supplied to the multiplying circuit 50L$^{(n)}$ was supplied to the delay circuit 43$^{(n)}$ is different from the time elapsed since the sample value which is to be supplied to the multiplying circuit 50R$^{(n)}$ was supplied to the delay circuit 43$^{(n)}$. In other words, the phase of a left channel signal which makes up a resonance tone and the phase of a right channel signal which makes up the resonance tone are shifted from each other. By the phase shift between the left channel signal and the right channel signal, this embodiment can imitate resonance tones of an acoustic piano more faithfully.

Furthermore, an index of the delay element connected to the multiplying circuit 50L$^{(n)}$ of the resonance tone generation circuit 30$^{(n)}$ is different from an index of the delay element connected to the multiplying circuit 50L$^{(m\neq n)}$ of a different resonance tone generation circuit 30$^{(m\neq n)}$. An index of the delay element connected to the multiplying circuit 50R$^{(n)}$ of the resonance tone generation circuit 30$^{(n)}$ is different from an index of the delay element connected to the multiplying circuit 50R$^{(m\neq n)}$ of a different resonance tone generation circuit 30$^{(m\neq n)}$. More specifically, the time elapsed since the sample value which is to be supplied to the multiplying circuit 50L$^{(n)}$ was supplied to the delay circuit 43$^{(n)}$ is different from the time elapsed since the sample value which is to be supplied to the multiplying circuit 50L$^{(m\neq n)}$ was supplied to the delay circuit 43$^{(m\neq n)}$. In addition, the time elapsed since the sample value which is to be supplied to the multiplying circuit 50R$^{(n)}$ was supplied to the delay circuit 43$^{(n)}$ is different from the time elapsed since the sample value which is to be supplied to the multiplying circuit 50R$^{(m\neq n)}$ was supplied to the delay circuit 43$^{(m\neq n)}$. In other words, the phases of resonance tones generated, respectively, by the two resonance tone generation circuits to which different key numbers are assigned are shifted from each other. By the phase shift between the resonance tones generated by the two resonance tone generation circuits to which different key numbers are assigned, this embodiment can imitate resonance tones of an acoustic piano more faithfully.

Furthermore, the present invention is not limited to the above-described embodiment, but the embodiment can be variously modified without departing from the object of the invention.

For instance, the above-described embodiment is designed such that the resonance circuit control portion 61 uses the various kinds of tables to generate the resonance frequency setting information. However, the embodiment may be modified such that the resonance circuit control portion 61 analyzes the fundamental tone and overtones of a musical sound PS$^{(n)}$ indicated by a digital musical tone signal supplied from the tone generator 16 to figure out resonance frequency setting information by numerical calculation such that the difference between the frequencies of the analyzed fundamental tone and overtones, and the resonance frequencies of the resonance tone generation circuit 30$^{(n)}$ is equal to or lower than a predetermined threshold value.

Figure 23:
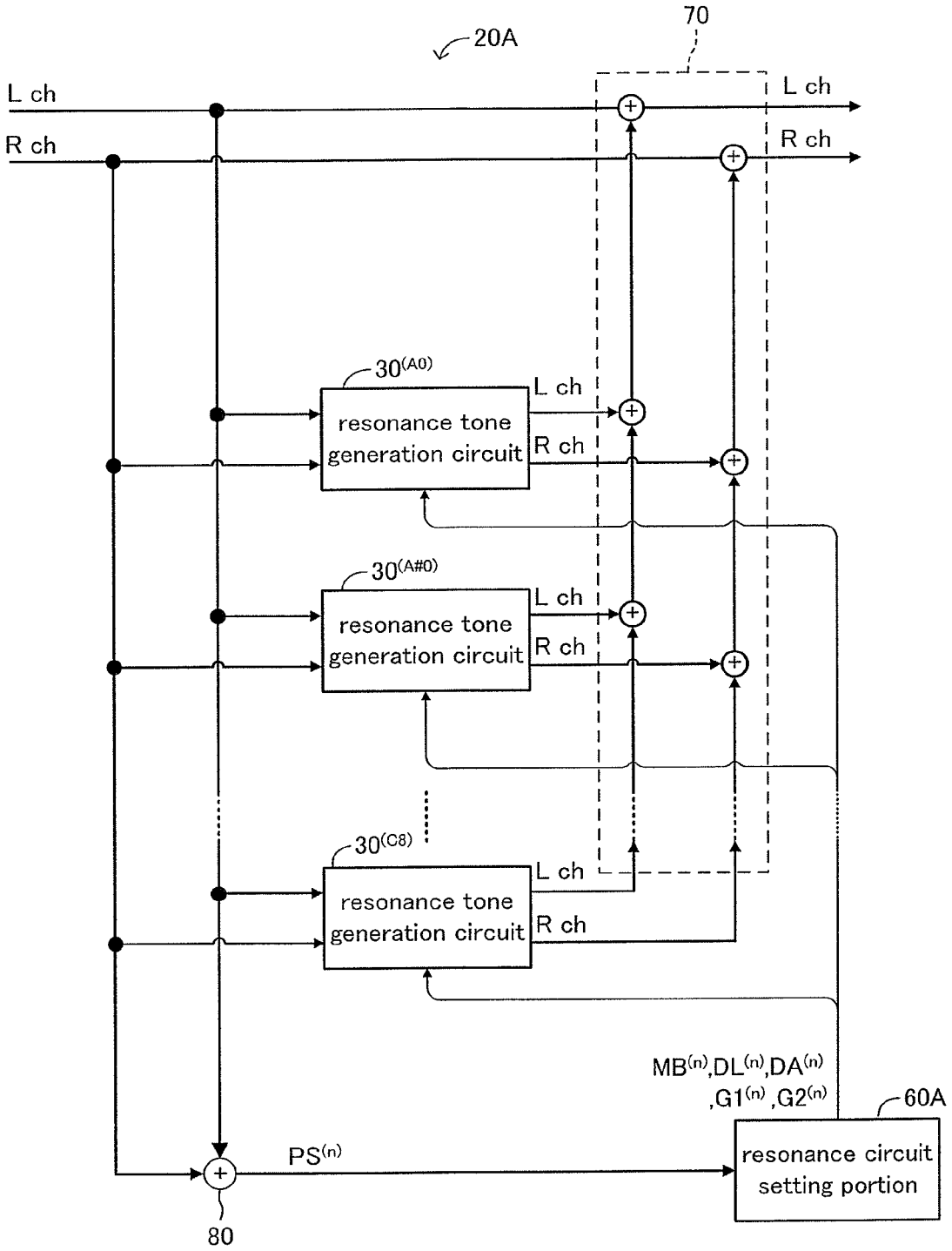
FIG. 23 is a block diagram showing a configuration of a resonance tone generation apparatus according to a modification of the present invention.

In this modification, the resonance tone generation apparatus 20 may be replaced with a resonance tone generation apparatus 20A indicated in FIG. 23. More specifically, the resonance tone generation apparatus 20A has an adding circuit 80 which adds a left channel signal and a right channel signal which make up a musical sound PS$^{(n)}$ supplied from the tone generator 16, and supplies the added signal to the resonance circuit control portion 61. In this modification, the resonance tone generation circuit 30$^{(n)}$ and the adding portion 70$^{(n)}$ are configured similarly to those of the above-described embodiment. A resonance circuit setting portion 60A has the resonance circuit control portion 61 which is similar to that of the above-described embodiment, but the resonance circuit setting portion 60A does not have the tables used in the above-described embodiment.

Figure 24:
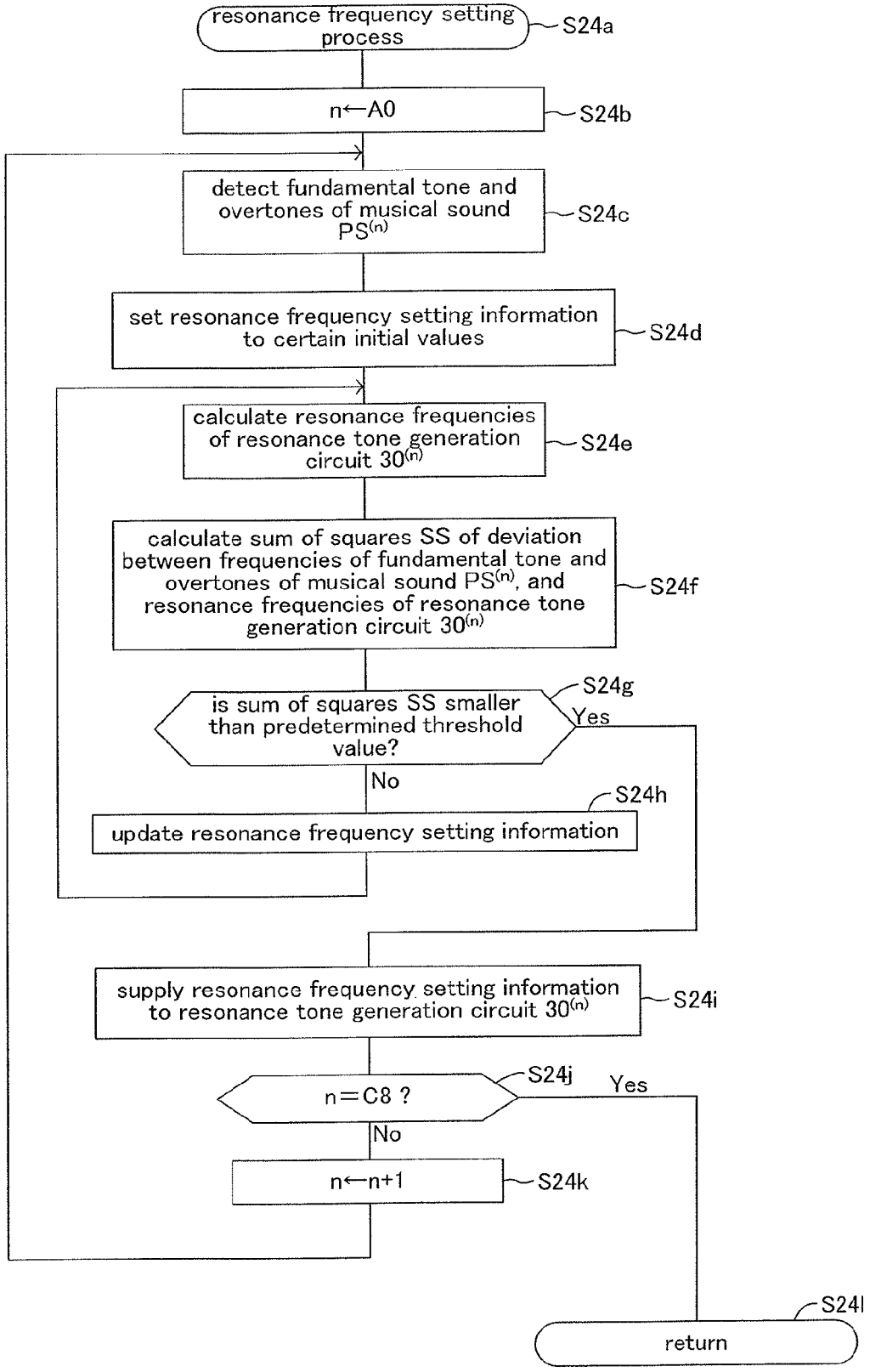
FIG. 24 is a flowchart of a resonance frequency setting program executed by the resonance tone generation apparatus of FIG. 23.

In this modification, the resonance circuit control portion 61 omits the flag setting process (step S23) in the resonance circuit setting process (FIG. 19), and executes a resonance frequency setting process indicated in FIG. 24 instead of the resonance frequency setting process (step S24).

Next, the resonance frequency setting process indicated in FIG. 24 will be explained. The resonance circuit control portion 61 starts the resonance frequency setting process at step S24*a*. Then, the resonance circuit control portion 61 sets the key number n to "A0" at step S24*b*. At step S24*c*, the resonance circuit control portion 61 makes the tone generator 16 generate a musical sound PS$^{(n)}$, retrieves the musical sound PS$^{(n)}$ from the tone generator 16, and Fourier-transforms the retrieved musical sound PS$^{(n)}$ to detect frequencies of a fundamental tone and an overtone of the musical sound PS$^{(n)}$. Since a rising portion of the musical sound PS$^{(n)}$ has noise (frequency component irrelevant to vibration of strings), it is preferable to detect respective frequencies (frequency response of the musical sound $PS^{(n)}$) of the fundamental tone and overtones of a middle portion of the musical sound $PS^{(n)}$.

Then, the resonance circuit control portion 61 sets resonance frequency setting information (delay length data $DL^{(n)}$, delay length adjustment data $DA^{(n)}$, first inharmonic component setting data $G1^{(n)}$ and second inharmonic component setting data $G2^{(n)}$) to certain initial values at step S24*d*. At step S24*e*, the resonance circuit control portion 61 calculates respective resonance frequencies (amplitude characteristics of resonance tones generated by the resonance tone generation circuit $\mathbf{30}^{(n)}$) of the resonance tone generation circuit $\mathbf{30}^{(n)}$ in accordance with transfer functions of the resonance tone generation circuit $\mathbf{30}^{(n)}$ in a state where the delay length data $DL^{(n)}$, delay length adjustment data $DA^{(n)}$, first inharmonic component setting data $G1^{(n)}$ and second inharmonic component setting data $G2^{(n)}$ have been supplied. At step S24*f*, the resonance circuit control portion 61 figures out the sum of squares SS of deviation between the detected frequencies of the fundamental tone and overtones of the musical sound $PS^{(n)}$, and the calculated resonance frequencies of the resonance tone generation circuit $\mathbf{30}^{(n)}$. At step S24*g*, the resonance circuit control portion 61 judges whether or not the sum of squares SS is smaller than a predetermined threshold value. If the sum of squares SS is smaller than the predetermined threshold value, the resonance circuit control portion 61 determines "Yes", and proceeds to step S24*i* which will be explained later. If the sum of squares SS is equal to or greater than the predetermined threshold value, the resonance circuit control portion 61 determines "No", updates the resonance frequency setting information (any one or more of the delay length data $DL^{(n)}$, delay length adjustment data $DA^{(n)}$, first inharmonic component setting data $G1^{(n)}$ and second inharmonic component setting data $G2^{(n)}$) at step S24*h*, and proceeds to step S24*e*.

If the sum of squares is smaller than the predetermined threshold value, the resonance circuit control portion 61 determines "Yes", and supplies the resonance frequency setting information to the resonance tone generation circuit $\mathbf{30}^{(n)}$ at step S24*i*.

At step S24*j*, the resonance circuit control portion 61 judges whether or not the key number n is "C8". If the key number n is "B7" or lower, the resonance circuit control portion 61 determines "No", increments the key number n at step S24*k*, and proceeds to step S24*c*. If the key number n is "C8", the resonance circuit control portion 61 terminates the resonance tone color setting process at step S24*l*, and proceeds to step S25 of the resonance circuit setting process.

At step S24*c*, without retrieving the musical sound $PS^{(n)}$, the resonance circuit control portion 61 may calculate the frequencies of the fundamental tone and overtones of the musical sound $PS^{(n)}$ by reading out waveform data from the waveform memory and analyzing the waveform data.

Furthermore, the resonance circuit control portion 61 may set the resonance frequency setting information to the certain initial values and supply the resonance frequency setting information to the resonance tone generation circuit $\mathbf{30}^{(n)}$ at step S24*d*, so that the resonance circuit control portion 61 can supply impulse signal or white noise to the resonance tone generation circuit $\mathbf{30}^{(n)}$ to detect respective resonance frequencies of the resonance tone generation circuit $\mathbf{30}^{(n)}$ on the basis of the response from the resonance tone generation circuit $\mathbf{30}^{(n)}$ at step S24*e*.

Such a modification can eliminate the need for the tables used in the above-described embodiment to simplify the configuration of the resonance tone generation apparatus 20A.

Although the electronic musical instrument DM of the above-described embodiment has a pair of right and left speakers, the electronic musical instrument DM may have three or more speakers. In this modification, it is preferable that the panning setting circuit $\mathbf{50}^{(n)}$ has the same number of multiplying circuits as the speakers. Furthermore, it is preferable that the modification is configured such that a sample value is supplied to each multiplying circuit from a different delay element which makes up the delay circuit $\mathbf{43}^{(n)}$.

In the above-described embodiment, furthermore, musical sounds of the respective tone pitches of the keys are sampled in the state where various models of pianos are tuned in equal temperament, with the master tuning of 440 Hz without stretch tuning. However, musical sounds of tone pitches of the keys of pianos such as pianos tuned in a temperament which is not equal temperament, and pianos whose master tuning is not 440 Hz may be sampled to be stored in the waveform memory so that the pitch of each musical sound can be corrected when the musical sound is played.

Furthermore, the resonance tone generation circuits $\mathbf{30}^{(n)}$ may be realized by using a DSP which executes digital signal processing in accordance with a certain micro-program. Furthermore, the resonance tone generation circuits $\mathbf{30}^{(n)}$ may be realized by use of a combination of discrete parts, a combination of single-function integrated circuits, a PLD (Programmable Logic Device) programmed, or a dedicated ASIC (Application Specific Integrated Circuit). Furthermore, part of or the entire of the resonance tone generation circuits $\mathbf{30}^{(n)}$ may be realized by the computer portion 12.

Furthermore, the circuit configuration of the resonance tone generation circuits $\mathbf{30}^{(n)}$ may not be the one described in this specification, but may be any circuit configuration as long as the configuration has similar characteristics. In this embodiment, furthermore, although the first inharmonic component generation circuits $\mathbf{45}^{(n)}$ and the second inharmonic component generation circuits $\mathbf{46}^{(n)}$ which are composed of all-pass filters and are connected in series are used in order to generate inharmonic component, all-pass filters having a different configuration from this embodiment may be used. By using higher-order all-pass filters, particularly, more complicated characteristics of inharmonic component may be imitated to have characteristics similar to targeted acoustic pianos.

In the above-described embodiment, furthermore, the predetermined decay coefficient is multiplied at the multiplying circuits $\mathbf{47}^{(n)}$, on the understanding that the signals traveling in the resonance circuits $\mathbf{40}^{(n)}$ decay uniformly regardless of frequency band. Strictly speaking, however, vibrations of strings of acoustic pianos repeat reflecting by a bridge and the like. Therefore, decay speed of frequency component varies with frequency bands. Particularly, frequency components included in a high frequency band decay fast. In order to reproduce the phenomenon more faithfully, low-pass filters having certain characteristics may be used instead of the multiplying circuits $\mathbf{47}^{(n)}$.

In the above-described embodiment, furthermore, the resonance tone generation circuit $\mathbf{30}^{(n)}$ is provided for each key number n. As a result, generation of a resonance tone by a string corresponding to one key is imitated. On acoustic pianos, however, each key has a plurality of strings tuned in unison, so that the plurality of strings generate a resonance tone. In this embodiment, assuming that the plurality of strings behave almost similarly, one resonance tone generation circuit $\mathbf{30}^{(n)}$ is provided for each key number n. Strictly speaking, however, the plurality of strings do not behave completely the same. For instance, the propagation velocity of string vibration slightly varies due to slight differences in tension. In order to imitate such differences, the embodiment may be modified to provide a plurality of resonance tone generation circuits $30^{(n)}$ for each key number n so that resonance tones generated by the plurality of strings, respectively, can be imitated.

Furthermore, the above-described embodiment is applied to the case in which the resonance tone generation apparatus 20 according to the present invention is applied to the electronic musical instrument which imitates acoustic pianos. However, the resonance tone generation apparatus 20 according to the present invention can be applied not only to the electronic musical instrument which imitates acoustic pianos but also to electronic musical instruments which imitate different acoustic musical instruments (polyphonic musical instruments). The polyphonic musical instrument indicates a musical instrument which has a plurality of vibrating bodies each corresponding to a certain tone pitch so that the vibrating bodies operated by a player for musical performance can directly generate musical tones, while the vibrating bodies which are not operated for musical performance can generate resonance tones by being resonated by the musical tones generated by the vibrating bodies operated by the player for musical performance. The polyphonic musical instruments include harpsichord, Japanese harp and the like, for example, having strings serving as vibrating bodies, similarly to acoustic pianos. Furthermore, the polyphonic musical instruments may be celesta, marimba and the like having bars serving as vibrating bodies. Furthermore, the polyphonic musical instruments may be tubular bells having tubular bells serving as vibrating bodies.

In a case where acoustic musical instruments having bars, tubular bells or the like serving as vibrating bodies are imitated, similarly to the above-described embodiment, assuming that the vibration of the vibrating bodies is almost one-dimensional, each resonance tone generation circuit may include a delay loop and an inharmonic component generation circuit for adjusting characteristics of the delay loop. Furthermore, the resonance tone generation circuits may be configured more elaborately by modeling the vibrating bodies more precisely.

What is claimed is:

1. A resonance tone generation apparatus applied to an electronic musical instrument having a tone generator which generates a musical tone signal indicative of a musical sound which has a tone pitch specified by a tone pitch number and is generated by a polyphonic musical instrument by vibrating a vibrating body corresponding to the tone pitch number, in accordance with a tone generation instruction signal including the tone pitch number, the resonance tone generation apparatus comprising:

a plurality of resonance tone generation portions each of which is assigned a different tone pitch number and is configured to have a plurality of resonance frequencies, each of the plurality of resonance tone generation portions retrieving a musical tone signal indicative of a musical sound of the polyphonic musical instrument and generating a musical tone signal indicative of a resonance tone imitating a tone of a vibrating body of the polyphonic musical instrument resonated by the musical sound of the polyphonic musical instrument indicated by the retrieved musical tone signal; and a resonance frequency setting portion for allowing respective resonance frequencies of the each resonance tone generation portion to coincide with frequencies of a fundamental tone and overtones of the musical sound generated by the tone generator in accordance with tone generation instruction information including the tone pitch number assigned to the each resonance tone generation portion.

2. The resonance tone generation apparatus according to claim 1, wherein each of the plurality of resonance tone generation portions has:

a delay portion for retaining the retrieved musical tone signal and delaying the retained musical tone signal;

a delay length adjustment portion for uniformly delaying phase of an entire frequency band of the musical tone signal delayed by the delay portion to adjust a period of delay time delayed by the delay portion;

one or more phase shift portion having phase characteristic which delays a low frequency component of the musical tone signal delayed by the delay portion and the delay length adjustment portion longer than a high frequency component; and an adding portion for adding the musical tone signal in which respective phases of the frequency components were shifted by the one or more phase shift portion to a musical tone signal newly retrieved from the tone generator, and then supplying the added musical tone signal to the delay portion; and the resonance frequency setting portion specifies a period of time for which the musical tone signal is to be retained by the delay portion, phase characteristic of the delay length adjustment portion, and the phase characteristic of the one or more phase shift portion such that the respective resonance frequencies of the resonance tone generation portion coincide with the frequencies of the fundamental tone and overtones of the musical sound generated by the tone generator in accordance with the tone generation instruction information including the tone pitch number assigned to the resonance tone generation portion.

3. The resonance tone generation apparatus according to claim 2, wherein a total period of time during which the musical tone signal is to be delayed by the delay portion and the delay length adjustment portion has an integer portion and a decimal portion; and the resonance frequency setting portion determines a period of time for which the musical tone signal is to be retained by the delay portion in accordance with a value of the integer portion, and specifies the phase characteristic of the delay length adjustment portion in accordance with a value of the decimal portion.

4. The resonance tone generation apparatus according to claim 2, wherein the resonance tone generation apparatus is applied to an electronic musical instrument on which tone pitches and a tone color of musical sounds of the polyphonic musical instrument can be specified in accordance with musical sound setting information including model information indicative of a model of polyphonic musical instrument imitated by the electronic musical instrument, and tuning system information indicative of setting on tuning, the electronic musical instrument being capable of externally outputting the musical sound setting information;

the resonance frequency setting portion has:

a musical sound setting information retrieving portion for retrieving the musical sound setting information;

a basic table which specifies a parameter specifying a total period of time during which a musical tone signal is to be delayed by the delay portion and the delay length adjustment portion, and a parameter specifying phase characteristic of the one or more phase shift portion in a case where a reference tone has a certain tone pitch, while the electronic musical instrument is to imitate a certain model of polyphonic musical instrument tuned by a certain tuning system, for each of the plurality of resonance tone generation portions; and a plurality of correction tables which specify a coefficient which is to be multiplied by the parameters of the basic table in a case where the electronic musical instrument is to imitate the certain model of polyphonic musical instrument tuned by a tuning system different from the certain tuning system, the coefficient being provided for each of tuning systems which are different from the certain tuning system; and in accordance with the retrieved musical sound setting information, by use of the basic table and one or more of the correction tables, the period of time for which the musical tone signal is to be retained by the delay portion, the phase characteristic of the delay length adjustment portion, and the phase characteristic of the one or more phase shift portions are specified for each of the plurality of resonance tone generation portions.

5. The resonance tone generation apparatus according to claim 4, wherein at least one of the correction tables is formed of twelve coefficients each corresponding to a different pitch name.

6. The resonance tone generation apparatus according to claim 2, wherein the resonance frequency setting portion has:

a frequency response detecting portion for sequentially retrieving musical sounds each having a different tone pitch of the polyphonic musical instrument from the tone generator, and detecting respective frequencies of fundamental tones and overtones of the musical sounds each having a different tone pitch of the polyphonic musical instrument;

an initializing portion for initializing the period of time for which the musical tone signal is to be retained by the delay portion, the phase characteristic of the delay length adjustment portion, and the phase characteristic of the one or more phase shift portion to certain initial values for each of the plurality of resonance tone generation portion;

a resonance frequency detecting portion for detecting resonance frequencies of each of the plurality of resonance tone generation portion; and an optimizing portion for optimizing resonance frequencies of each of the plurality of resonance tone generation portion by repeatedly updating the period of time for which the musical tone signal is to be retained by the delay portion, the phase characteristic of the delay length adjustment portion, and the phase characteristic of the one or more phase shift portion for each of the plurality of resonance tone generation portion until a difference between the resonance frequencies of the each resonance tone generation portion and the frequencies of the fundamental tone and overtones of the polyphonic musical instrument's musical sound having a corresponding tone pitch generated by the tone generator in accordance with the tone generation instruction information including the tone pitch number assigned to the each resonance tone generation portion becomes smaller than a certain threshold value.

7. The resonance tone generation apparatus according to claim 1, wherein the polyphonic musical instrument is a piano; and the vibrating body is a string of the piano.

8. A computer program included in a non-transitory computer-readable medium, the computer program causing a computer incorporated in a resonance tone generation apparatus applied to an electronic musical instrument having a tone generator which generates, in accordance with a tone generation instruction signal including a tone pitch number, a musical tone signal indicative of a musical sound of a polyphonic musical instrument having a plurality of vibrating bodies each corresponding to a different tone pitch number, the musical sound having a tone pitch specified by the tone pitch number, to function as the resonance tone generation apparatus comprising:

a plurality of resonance tone generation portions each of which is assigned a different tone pitch number and is configured to have a plurality of resonance frequencies, each of the plurality of resonance tone generation portions retrieving a musical tone signal indicative of a musical sound of the polyphonic musical instrument and generating a musical tone signal indicative of a resonance tone imitating a tone of a vibrating body of the polyphonic musical instrument resonated by the musical sound of the polyphonic musical instrument indicated by the retrieved musical tone signal; and a resonance frequency setting portion for allowing respective resonance frequencies of the each resonance tone generation portion to coincide with frequencies of a fundamental tone and overtones of the musical sound generated by the tone generator in accordance with tone generation instruction information including the tone pitch number assigned to the each resonance tone generation portion.

* * * * *